US008109283B2

(12) United States Patent
Pavlicevic et al.

(10) Patent No.: US 8,109,283 B2
(45) Date of Patent: Feb. 7, 2012

(54) APPARATUS AND PROCESS FOR THE DRY REMOVAL OF THE SCALE FOUND ON THE SURFACE OF THE METAL PRODUCTS

(75) Inventors: Milorad Pavlicevic, Udine (IT); Alfredo Poloni, Fogliano Redipuglia (IT); Alessandra Primavera, Udine (IT); Fabio Guastini, Dolegna Del Collio (IT); Alejandro Sanz Lara, Gemona (IT); Fabio Vecchiet, Villa Vicentina (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 1303 days.

(21) Appl. No.: 12/310,838

(22) PCT Filed: Nov. 14, 2003

(86) PCT No.: PCT/EP03/12781

§ 371 (c)(1), (2), (4) Date: Mar. 9, 2009

(87) PCT Pub. No.: WO2004/046423

PCT Pub. Date: Jun. 3, 2004

(65) Prior Publication Data

US 2010/0242990 A1 Sep. 30, 2010

(30) Foreign Application Priority Data

Nov. 15, 2002 (IT) ..... MI2002A2424

(51) Int. Cl.
*B08B 5/00* (2006.01)

(52) U.S. Cl. ..... 134/105; 148/660; 266/251; 266/252; 266/259

(58) Field of Classification Search ..... 134/2, 15, 134/17, 30, 37, 105; 148/657, 658, 660; 266/81, 251, 252, 259
See application file for complete search history.

(56) References Cited

U.S. PATENT DOCUMENTS 4,576,837 A 3/1986 Tarancon et al.
6,406,550 B1 * 6/2002 Feldbauer et al. ..... 134/2

FOREIGN PATENT DOCUMENTS

DE 195 19 544 A1 11/1996

* cited by examiner

*Primary Examiner* — Michael Kornakov
*Assistant Examiner* — Douglas Lee
(74) *Attorney, Agent, or Firm* — Stetina Brunda Garred & Brucker

(57) ABSTRACT

An apparatus and process for the dry removal of the scale from the surface of a metal product comprising at least one heating area that does not reduce the specific surface of the material to be treated and does not cause oxidation, at least one reducing area for performing the reaction between a specific reducing gas (normally hydrogen) and at least the scale, at least one cooling area for cooling the metal product, means for heating the metal product, means for heating the reducing gas, means for controlling the fluid dynamics of the boundary layer produced by the flow of said reducing gas over the surface of the metal product, means for removing the reaction products front the reducing gas after the reaction, means for cooling the metal product, and means for removing the reaction products from the treated surface of the metal product.

30 Claims, 20 Drawing Sheets

Specific surface ($m^2/g$)
Experimental data at Temperature: constant
Time

Specific surface ($m^2/g$)
45
40
35
30
25
20
15
10
5
0
0
200
400
600
800
1000
1200
1400

Reduction temperature (°C)

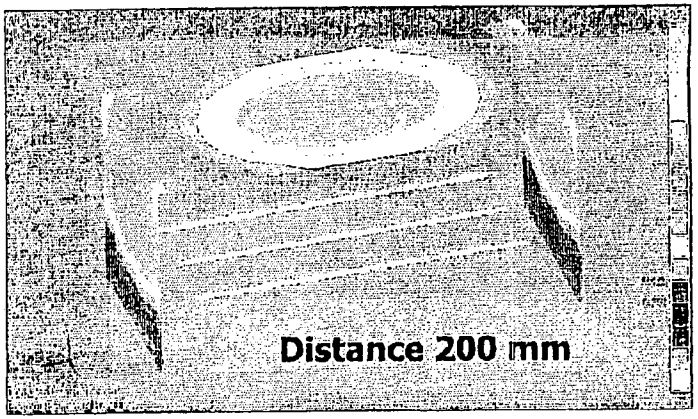
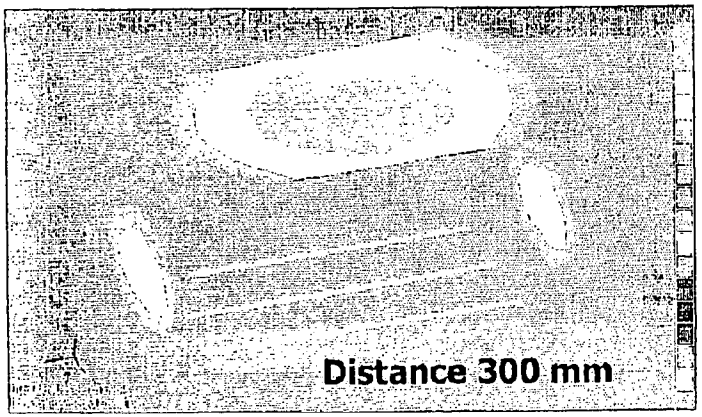
FIG. 10
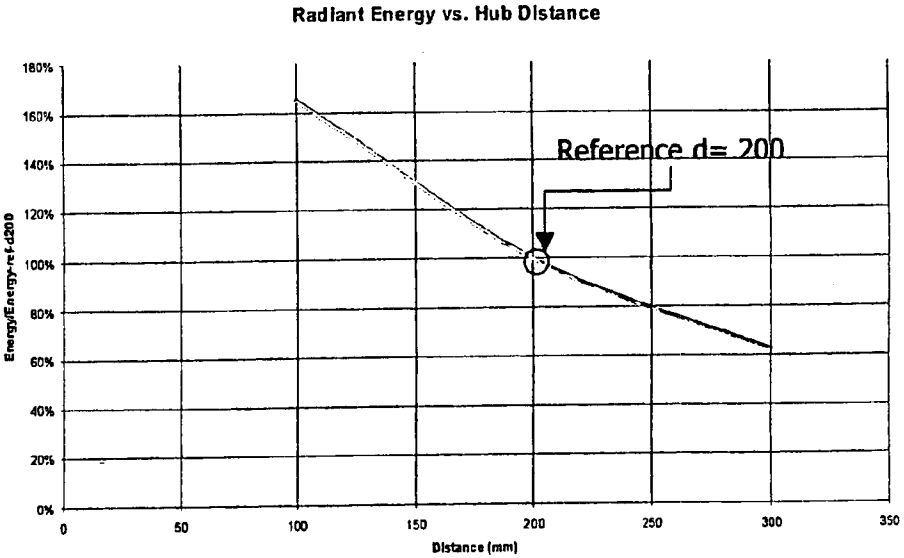
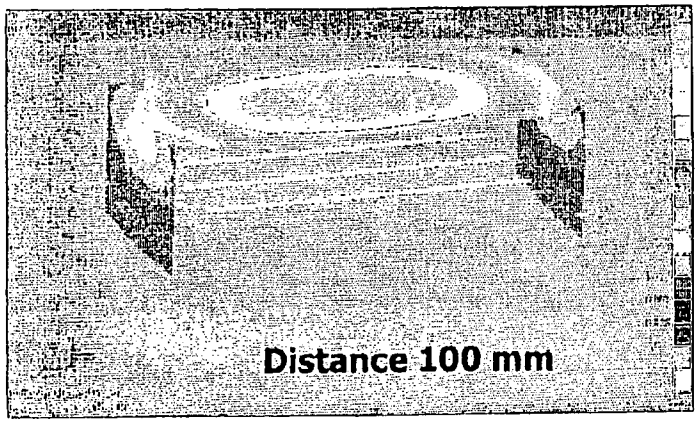

STEP I : reduction of the outer oxide layer with heating from the metal

STEP II: reduction of the oxide with heating from the metal and from the sponge iron

STEP III: final reduction of the oxide with heating from the sponge iron

*Thermal flow*

× × *Current lines*

APPARATUS AND PROCESS FOR THE DRY REMOVAL OF THE SCALE FOUND ON THE SURFACE OF THE METAL PRODUCTS

CROSS-REFERENCE TO RELATED APPLICATIONS

This application is a divisional of U.S. patent application Ser. No. 10/535,127 filed on May 16, 2005 which claims priority to Italian Application No. MI2002A002424 filed Nov. 15, 2002, the entireties of which are herein incorporated by reference.

TECHNICAL FIELD

This invention relates to an apparatus and a process for the dry removal of the scale found on the surface of metal products. More particularly, it relates to an apparatus and process for treating metal products in the shape of bars, strips, or other types of iron and steel products.

BACKGROUND ART

The background art described in this document focuses specifically on ferrous alloys; however, the apparatus and the process in accordance with the invention applies to all metal materials.

Compared to iron oxidation, steel oxidation is also affected by the behaviour of the elements found in the steel alloy. Although the oxidation phenomena are more complex, surface scale found on steel products is typically formed by iron oxides and always contains FeO (also called wustite), $Fe_3O_4$ (also called magnetite), $Fe_2O_3$ (also called haematite), and $Fe(OH)_3$ or FeOOH (also called rust or limonite). Following exposure to pure air or oxygen, the scale formed on pure iron consists of several layers. Below 570° C., FeO is unstable and only $Fe_3O_4$ and $Fe_2O_3$ are present; while, above said temperature, an internal layer of FeO is formed along with the two oxides. Often, the presence of other elements leads to structural changes in the scale and affects the growth kinetics of the scale. Furthermore, the underlying metal is modified due to the phenomenon of selective oxidation of this binding additional material.

Most scale formed during steel production develops at much higher temperatures than 570° C.; consequently, all three aforementioned oxides are present. It is generally believed that the diffusion of vacancies in FeO and in $Fe_3O_4$ and the diffusion of oxygen in $Fe_2O_3$ contributes to the growth of said oxides in pure iron. Nevertheless, the diffusion of ferrous gaps or vacancies can also occur in $Fe_2O_3$; while, both in $Fe_2O_3$ and in $Fe_3O_4$ the diffusion of oxygen along the distribution channels, the edges of the grains, and microcracks can significantly promote the formation of the phenomenon. The kinetics of oxidation can be controlled by the reactions that occur at the different interfaces between the following: Fe and FeO, FeO and $Fe_3O_4$, $Fe_2O_3$ and $Fe_3O_4$.

Sometimes, oxidized products are exposed for prolonged periods of time to industrial and/or sea air. This, leads to considerable rusting (thick layers of complex iron hydroxides (millimetres). Therefore the products to be pickled can appear like material coated by a dark grey layer, e.g. black strip, made of mixed oxides, whose thickness is comprised between fractions of μm and 10 μm maximum. Generally this kind of scale is the easiest to be removed. It is more difficult to remove the scale from materials having been subject to corrosion so as to produce a thick layer of oxides or very deep cavities, even in the range from 50 to 100 μm.

The most widely used process for removing scale from metal products is pickling with acid; this process involves treating the metal products with $H_2SO_4$ or HCl at a temperature of approximately 80° C. for a period of time ranging from 10 to 30 minutes. The thicker the scale layer, the longer the required pickling time; while, is the temperature remains constant.

For example, before drawing metal products, the metal is normally cleaned by immersing the coils in a container filled with hot hydrochloric or sulphuric acid. Sulphuric acid mainly eliminates scale by means of a mechanical, rather than chemical, action. The acid is able to penetrate into the metal under the scale layer where it reacts with the iron forming water-soluble iron sulphate and releasing a gas mixture consisting mainly of $H_2$.

This action detaches the scale from the iron; then, at the end of the pickling process with acid, the surfaces of the metal product are cleaned with high-pressure jets of water.

Temperature control plays an important role in this type of pickling since the speed of the acid-metal reaction is highly affected by temperature; for example, the reaction is 100 times faster at 88° C. than at ambient temperature. At the other end of the scale, overheating the acid wastes energy, consumes an excessive amount of acid very quickly, and creates unnecessary fumes that are highly corrosive to the structure of the plant. Not only, acid at high temperatures is also damaging to the surface of the metal: it produces pitting. To help prevent pitting or the excessive decomposition of the metal surface, inhibitors are commonly used. Said inhibitors are products based on nitrogenous hydrocarbons. The time required to clean the metal product varies depending on the type of scale to be eliminated and the type of metal to be treated. This can range from 10 minutes for bars with a high-carbon content to 35 minutes for bars with a low-carbon content and a considerable amount of scale. For this reason, pickling with acid is most suited for metal surfaces covered with a thin scale layer.

After cleaning with water jets, the metal product pickled with acid is rinsed and covered with a protective coating.

The main drawback of using the acid pickling method is the significant negative environmental impact and the reduced kinetics of the reaction. The acid residues found in the acid baths are potentially dangerous; handling, disposing of, and storing these products is complex and costly. Furthermore, depending on the type of scale to be eliminated, efficiency can fall to below 33%.

Another commonly used method is mechanical descaling; this, can be done through bending, shot peening, sand blasting, brushing, or using ultrasounds. Once again, the purpose of these methods is to detach, remove, or break off mechanically the scale layer. Mechanical descaling is more effective on fragile scale with low adherence to the metal product; thus, mechanical descaling is more appropriate for thick layers of the scale since, the thicker the scale layer, the lower its bond to the metal.

Another pickling method involves the use of a salt in liquid form. $K_2O$ ($Na_2O$, $SiO_2$) based salts are able to dissolve iron oxides and produce two immiscible liquids. The liquid with the highest content of FeO can be regenerated. The regenerated salt will be reutilized for pickling. Thus, the scale is washed with a liquid and the acid is replaced by a bath of dissolved salts.

Several known descaling processes—for example, those described in U.S. Pat. No. 2,197,622 and U.S. Pat. No. 2,625,495—feature, at a specific stage of the descaling process, the injection of a condensed reagent, liquid or solid, combined with some form of intermediate gaseous oxidizing reaction.

Document WO 00/03815 describes a dry descaling process where the scale is removed from the strip in a chamber; here, the surface of the strip is heated, exclusively through induction winding, and $H_2$ flows only in a counter current manner. The solution described in the WO '815 document involves the use of an amount of $H_2$ greater than the stoichiometric one; however, the efficiency of the process is not satisfactory neither from the technical nor financial point of view. Other known descaling processes use hydrogen and other reducing gases, such as carbon monoxide, to reduce oxides in minerals where they are substantially consumed in reducing furnaces or in containers or tanks. However, hydrogen burns easily and can be an explosion hazard; while, carbon monoxide is a toxic gas and is generally considered dangerous if not confined and made react in a tank of the type generally used for reducing minerals. Thus, although the basic chemical principles for reducing oxides with gases are known, the state-of-the-art technology does not include technical solutions that make it possible to perform fast, homogenous, and compact processes for removing the scale from metal surfaces in a continuous manner.

In the process described in U.S. Pat. No. 6,217,666 and in U.S. Pat. No. 6,402,852, hereinafter also referred to as acid-free pickling, or AFP, surface oxides are reduced by using a reducing gas, for example $H_2$ or CO, at the right temperature. The plant described in the aforementioned patents comprises a reactor, where the metal product is descaled, that features three main functional areas, specifically:

a first heating area where the metal is raised from ambient temperature to the reaction temperature in a non-oxidizing atmosphere, a second reaction area where the metal is reduced in a reducing atmosphere and fans constantly renew the gas mixture, a third cooling area where the metal is cooled to 120° C., or lower, in a non-oxidizing atmosphere.

Depending on whether the type of furnace used in said first area is of the electric type only or also has $CH_4$ burners, the main inputs are, respectively, electricity only or electricity, $N_2$, $H_2$, and air-$CH_4$, the last item is used when the furnace is also equipped with natural gas burners. The products leaving the plant are water vapor and $H_2$ and, in the case of a furnace equipped with gas burners, also the combustion products of natural gas.

Acid-free pickling has many advantages over pickling with acid including the absence of dangerous toxic waste, the absence of corrosion on the metal surface, and the use of mildly aggressive cleaning means.

The main phases of this process, disclosed in U.S. Pat. No. 6,217,666 e U.S. Pat. No. 6,402,852, are the heating of the metal product, the reduction of the oxides, and the cooling of the metal product. The scale-reducing stage in the reaction area is carried out ensuring a turbulent and/or vigorous injection of the reducing gas, preferably in the presence of elementary carbon. A disadvantage of these types of processes is that gas flows in a disorderly manner inside the reactor, and hydrogen is supplied taking for granted that it will react with the scale found on the metal product. The presence of the chaotic gas flow inside the reactor limits the speed of reaction and significantly lengthens the descaling process. Furthermore the use of fans to recycle the reducing gas inside the reactor can cause accumulation of gas products issued from the reduction, e.g. $H_2O$, thus slowing down oxides reduction reactions in the same parts and causing a general reaction slow down and also product non-uniformity.

As a result, the efficiency of the AFP process is greatly reduced; alternatively, to offset this problem and obtain a level of productivity comparable to the one of traditional acid-pickling plants, the process must take place in very long plants. Apart from the inconveniences related to constructing a large plant, the large amount of reducing-gases required for the reactor present a great hazard in the event of an emergency. Furthermore, in very long plants, it is also necessary to take into account the significant amount of time required to fill the plant with the reducing gas, the significant duration of the thermal transient, and the high thermal losses; these factors make the AFP process financially less appealing compared to acid-based pickling processes.

Another problem that generally arises with acid-free pickling processes of the known type is the poorer quality results obtained when treating metal products totally covered with thick and/or highly adhesive scale. In this case, when a piece of metal covered with a uniform, or not, scale layer is fed through an AFP reducing plant, the top scale layer is reduced and the surface looks shiny. However, in many cases, the reduction does not occur throughout the thickness of the scale. In other cases, the reduction does not occur uniformly making the resulting metal surface not very suitable for further machining. Another drawback is that, the gaseous stages of the pickling process use heating and reducing techniques that have not specifically been designed for acid-free pickling; consequently, the efficiency of the entire process is reduced.

To date, there are no known AFP-type processes featuring the thermo-fluid dynamic control of the boundary layer of the reducing gas on the surface to be treated and a chemical control of the reducing mixture that achieve high reduction rates of the scale and a homogeneous reduction of all the points covered with scaling.

SUMMARY OF THE INVENTION

It is an object of this invention to resolve the aforementioned problems by providing a process for the dry removal of the scale of various thickness and chemical structure found on the surface of metal products which is fast, gives uniform and homogenous results throughout the surface of the metal item, be highly efficient, and take place in a pickling plant of contained dimensions.

It is another object of the invention to provide an apparatus for the dry removal of the scale of various thickness and chemical structure that is able to perform a fast pickling process without the use of acid; is of compact dimensions, flexible, cost effective, and suitable for industrialization; and achieves high chemical efficiency.

These objects, in accordance with a first aspect of the invention, are achieved by means of a dry-pickling apparatus for the removal of the scale from a surface of a metal product which, in accordance with the main claim, comprises at least one heating area for heating the metal product, at least one reducing area for performing a reaction between a metal-oxide reducing gas and at least the scale, at least one area for cooling the metal product, first heating means for heating the metal product, second heating means for heating the reducing gas, means for removing reaction products from the reducing gas after reaction, means for removing reaction products which are left on the surface of the metal product after treatment, and means for cooling the metal product; said dry-pickling apparatus being characterised by the fact that it comprises first control means for fluid dynamic control of the boundary layer produced by the flow of said reducing gas over the surface of said metal product wherein said first control means are adapted for generating regular pressure oscillations comprising overpressure and depression areas, which are repeated in succession along the entire surface of said metal product, the overpressure areas being associated with a reducing gas blowing stage the towards the surface of said metal product, and the depression areas being associated with a reducing gas evacuation phase downstream of the blowing stage, and in that it comprises second control means for controlling reducing gas chemical composition at the blowing stage, means adapted for purging and recycling reducing gas after reducing operation of the scale, third control means for controlling reducing gas temperature.

Preferably, said device includes, among the means for heating the metal product, in combination or alternatively, a microwave device, induction heating elements with or without frequency modulation, naked or screened burners that require oxygen or air in the pre-mixed form or not, gas or electric radiant tubes with amplified radiation, and induction and infrared heating devices.

Furthermore, the device comprises, among the heating means of the reducing gas, ducts made of hot refractory material through which the reducing gas flows or, alternatively or in combination, a heated metal wall licked by the reducing gas. Generally, the employed reducing gas is suitable for reducing, in its pure form or in combination with other neutral and/or reducing gases, metal oxides.

The apparatus provides for various possible devices for purifying the reaction gas from reaction products before reusing the same gas: adsorbers, absorbers or cryogenic systems.

Furthermore means are provided for mechanical removal of iron sponge produced from the reduction reaction between reducing gas and oxides forming the scale. Among the means used there are included brushes, abrasive blasting, solid $CO_2$ injection.

In accordance with another aspect of the invention, the objects of the invention are achieved by means of a dry descaling process for the removal of the scale on the surface of a metal product, which is carried out with the dry descaling apparatus as claimed in one of the previous claims, comprising at least one heating area for heating the metal product, at least one reducing area for performing a reaction between a metal-oxide reducing gas and at least the scale, at least one area for cooling the metal product, first heating means for heating the metal product, second heating means for heating the reducing gas, means for removing reaction products from the reducing gas after reaction, means for removing reaction products which are left on the surface of the metal product after treatment, and means for cooling the metal product, the process comprising the following steps:

a) providing a metal-oxide reducing gas, b) heating the metal product to a first temperature greater than ambient temperature without reducing and without oxidizing the specific surface of the material to be treated, c) heating the reducing gas to a second temperature greater than ambient temperature, d) maintaining the metal product in the reducing area for a predetermined amount of time, e) performing the reaction between said metal-oxide reducing gas and at least said scale, f) cooling the metal product to a predetermined temperature, g) removing the reaction products from the reducing gas after the reaction with the scale, h) removing the reaction products from the surface of the treated metal product, the process being characterized by:

i) controlling fluid dynamics of boundary layer of the flow of the reducing gas over the surface of the metal product in such a manner that there is provided an organised gas distribution and homogeneous gas concentrations adequate to the amount of the scale found on said surface and sufficient for removing the reaction products from said reducing gas, j) providing a blowing stage of the heated reducing gas to the surface of said metal product at a predetermined flow rate suitable for making the gas penetrate into pores of said scale whereby said blowing stage is associated with a corresponding overpressure area on the surface of said metal product, k) providing a predetermined reaction time adequate to remove oxygen from the scale, l) providing, by means of the boundary layer fluid dynamic control means, an evacuation flow of said reducing gas, after it has reacted in accordance with stage k), after said delivery flow, whereby said evacuation flow is associated with a corresponding depression area on the surface of said metal product, m) performing stages j) and l) cyclically in regular succession along the entire surface of said metal product, n) removing the reaction products from the reducing gas after the reaction with the scale.

Thanks to the inventive features of the invention, an apparatus is obtained that carries out a fast dry descaling process, environment-friendly and less expensive which can be carried out with only one feeding of the metal product through the plant, can be used with different types of heating devices in the first stage of the process, makes different improvements to the reduction process in the reaction area, and is of shorter dimensions than existing efficient dry process plants. In summary, the result of the invention is a fast, dry process for removing the scale that requires only one pass of the metal product through the plant and can use different types of heating devices, including the examples mentioned above, in the first stage of the process.

The process according to the invention enables the production of pickled material with higher productivity than the one attainable by means of any known process of the state of the art, with product quality of the same level as the one obtained by means of acid pickling, but with lower environmental impact and at a lower overall process cost. The high oxides reduction velocity is obtained by means of the following features introduced in the various stages during gas-solid reaction:

i) To overcome the physical resistance of the scale two main stages of the dry pickling process are provided, i.e. gas to gas diffusion and gas to solid diffusion during which the invention provides for the following features to improve reduction speed:

Choice of an organised reducing gas flow having the features:

High gas-solid velocity ($v>5$ m/s), high shear stress ($>0.03\div5$ Pa), high turbulent kinetic energy;

Overpressure zones ($>+10$ Pa),

Optimal gas and solid temperatures,

Rust removal from surface, and additionally brushing of the product to be treated in case of rust presence, choice of organised jets, material and gas heating by means of: inductors, burners, radiating pipes, microwaves, IR, NIR.

ii) to overcome the chemical resistances, three main stages of the pickling process are provided, i.e. reactants adsorbtion, reaction and products desorption, during which the invention provides for the following features to improve reduction speed:

gas temperature (300° C.<T<1100° C.)

purità of the reducing gas ($H_2O_{max}$=5%)

and additionally material and gas heating by means of: inductors, burners, radiating pipes, microwaves, IR, NIR, reducing gas purifying and recycling plant by means of adsorption, absorption, cryogenic systems, etc.

gas feed with specific consumption of 4÷100 $Nm^3/min*kg_{scale}$.

iii) to overcome the physical resistances in the last part of the process, two main stages of the pickling process are provided, i.e. gas-solid diffusion, and gas-gas diffusion, during which the invention provides for the following features to improve reduction speed:

Choice of an organised reducing gas flow having the features:

High gas-solid velocity (v>5 m/s), high shear stress (>0.03÷5 Pa), high turbulent kinetic energy;

Evacuation zones for gaseous reaction products, e.g. creation of an underpressure zone (>+2 Pa), Optimal gas and solid temperatures, and additionally choice of organised jets and provision of zones between jets for reaction products evacuation, material and gas heating by means of: inductors, burners, radiating pipes, microwaves, IR, NIR.

Compared to the known pickling process described in U.S. Pat. No. 6,217,666, the process carried out in the device of the invention involves the reduction of the iron oxides forming the scale by means of a reducing gas, which is in pure form or mixed with other neutral and/or reducing gases, without the use of any condensed reagent.

Another advantage of the device in accordance with the invention is that the process features a higher temperature range in which the reduction stage can take place and does not include the disadvantages typical of other acid-free processes, specifically the inability to achieve high or very high productivity levels. The device allows the process to begin at lower scale temperatures, starting from 100° C., in presence of warm gas. This entails that the process of the invention incorporates in the strip heating stage a first part of the reduction action itself.

In this invention, chemical, fluid dynamic, and pressure control in the heating and/or reaction areas is carried out accurately and continuously keeping under control the phenomena at the level of the boundary layer produced by the flow of the reducing gas over the surface of the metal product; thus, it does not involve simply generating a turbulent flow.

In order to minimise the physical resistances during the scale reduction reaction (diffusion and counter-diffusion gas-gas and gas-solid) it is necessary to minimise or eliminate the boundary sub-layer of the reducing gas flow, in which there occur main resistances against the reducing gas diffusion towards the surface to be treated and a consequent clearing of the reaction products, which would otherwise interrupt the reaction.

The choice of fluidodynamic enabling to reduce to a minimum the physical resistances in the scale reduction reaction (diffusion and counter-diffusion gas-gas and gas-solid) entails the use of high reducing gas velocities in proximity of the solid and consequently feeding of high flow rates ($Nm^3/min*kg_{scale}$).

The use of flow rates in the range of 4÷100 $Nm^3/min*kg_{scale}$ does not produce a high gas consumption since the oxidised molecules, produced during the reaction are separated and the gas is fed again in the process which becomes more cost effective.

The dynamic control of the reduction kinetics carried out in this way guarantees very fast reduction times with almost total homogeneousness. In fact, by controlling said boundary layer, an almost instantaneous reaction occurs, even in less than 1 sec, between the reducing gas and the scale; furthermore, the removal of the reaction products—mainly water vapor—from the surface of the metal product is optimized, making the surface chemically reactant to the reduction of the oxides.

What follows is a description of how this invention accomplishes, through the means for controlling the fluid dynamics of the boundary layer, the removal of the oxygen from the scale found on the surface of the metal product to be treated.

The heated reducing gas (in pure form or mixed with other neutral and/or reducing gases) is supplied at a flow rate adequate to make it penetrate into all the pores of the scale, guaranteeing a homogeneous concentration from 4 $Nm^3/(min\ kg_{scale})$ to 100 $Nm^3/(min\ kg_{scale})$. This penetrating distribution of the reducing gas is obtained at the same time as the production of overpressure areas, on the surface to be treated, with a value above approximately +10 Pa.

After the reaction between the reducing gas and the scale has taken place, the reducing gas is evacuated so that it removes the water produced during the reducing reaction; the molecules of water seep into the microcavities of the surface of the scale and/or the already reduced metal. The suction of the reducing gas, and thus the removal of the water of the reaction, is obtained at the same time as the production of depression areas, with intensity above −2 Pa in absolute value on the treated surface of the metal product; this prevents the formed water from saturating the reaction surface and blocking the process of removal of the oxygen from the scale.

More specifically, in the device of the invention, the removal of the water formed during the reaction can also be ascribed to the mechanical action of the flow of the reducing gas delivered to the surface of the metal product; this flow accelerates and moves away from the surface the water formed during the reaction, thus reducing at a minimum or even eliminating the thickness of the laminar boundary sub-layer and makes it possible for new molecules of reducing gas to reach the area. The mechanical action of the jet on the surface is quantified by a shear stress created by the fluid motion field with oscillations above 0.03 Pascal depending on the type of scale and of the reducing gas fed.

A system of distributed evacuation and gas dehumidification inside the device maintains a water vapor percentage, in every point of the device, and in particular in the laminar boundary sub-layer, of less than 5% in volume.

The reducing gas, without the steam, is put into circulation again for another oxide reducing cycle.

The process takes place along the descaling line with alternating cycles that involve the injection of the reducing gas, the evacuation of the reducing gas with the removal of the water vapor, the recovery of the cleaned reducing gas, and so on until the oxygen is fully removed from the scale.

The gas used to reduce the oxides making the scale is preferably, but not necessarily, hydrogen in pure form or mixed with other neutral and/or reducing gases such as nitrogen and/or helium and/or argon and/or carbon monoxide; the gas is supplied at a temperature ranging from 300° C. to 1100° C., assuring the controlled heating of the interface of the reaction (surface and thickness of the scale) in order to minimize the removal times of the reducing reaction. Thanks to heating, in fact, the diffusion of the reducing gas and its ions toward the inside of the scale, as well as the diffusion of the reaction products toward the outside, can be accelerated and handled efficiently.

After the removal of the oxygen from the scale, a layer of sponge iron remains on the surface of the metal product; this can be removed mechanically, for example, by brushing. The mechanical method adopted for the removal of iron sponge is characterised in that it does not damage the superficial quality of the material which has a roughness comparable to the one obtained by means of acid pickling. When the surface of the thus processed product is the one of a metal strip, this can immediately undergo the next machining stages, such as rolling or skin-pass rolling, without the need for further treatment.

DRAWINGS

These and other advantages of the invention shall be readily apparent from the more detailed description of the currently preferred version of the invention, given as a non-limiting example and in conjunction with the following accompanying drawings:

FIG. 10 shows a graph showing the progress of the transfer of the amplified radiation heat flow;

DESCRIPTION OF THE INVENTION

What follows is a description, with reference to the above figures, of a dry pickling process for reducing oxides constituting the scale performed in a pickling device without the use of acid. Hereinafter, the terms "dry" or "acid free" shall be used indifferently to refer to the process of the invention.

The first phase of the process to be implemented in the pickling device of the invention involves preparing mechanically (normally, through brushing) the surface of the metal product in order to remove impurities and rust from said surface, and heating the metal product with appropriate heating means. Said heating means can be of the convective (using the hot reducing gas), microwave, induction or amplified radiation type; heating can also be accomplished by means of screened burners (including radiant tubes) or naked burners or by means of IR (infrared) and NIR (near infrared).

The second phase of the process provides for the reduction of the oxides constituting the scale in the reducing area; this phase comprises a stage of emission of the heated reducing gas, preferably gaseous hydrogen in pure form or mixed with, other neutral and/or reducing gases such as nitrogen and/or helium and/or argon and/or carbon monoxide. The gas flow is controlled, in particular in the boundary layer found near the surface of the metal product, as are the pressures on the surface of the product itself.

The aforementioned hydrogen is heated to a specific temperature comprised between 300 and 1100° C. so that, already during the emission stage, the two actions can take place, specifically: heating of the surface of the metal product and simultaneous reduction of the oxides that are found in the scale. To perform this phase, two preferred versions of the invention are proposed for controlling the fluid dynamics of the boundary layer of the heated hydrogen at the surface of the metal product; these can be adopted as alternative solutions or used in series one after the other.

The first and second phase described above can be advantageously combined into a single phase of the process.

The third phase of the pickling process comprises an operation for cooling the metal product to a specific temperature; preferably, this operation is carried out by forced convective cooling using the reducing gas.

The fourth and last phase of the pickling process involves the mechanical removal of the reduced scale from the surface of the metal product; ideally, this operation is carried out by brushing.

The dry pickling process is carried out in a continuous manner and always by feeding the metal product through the pickling device only once.

Figure 1:
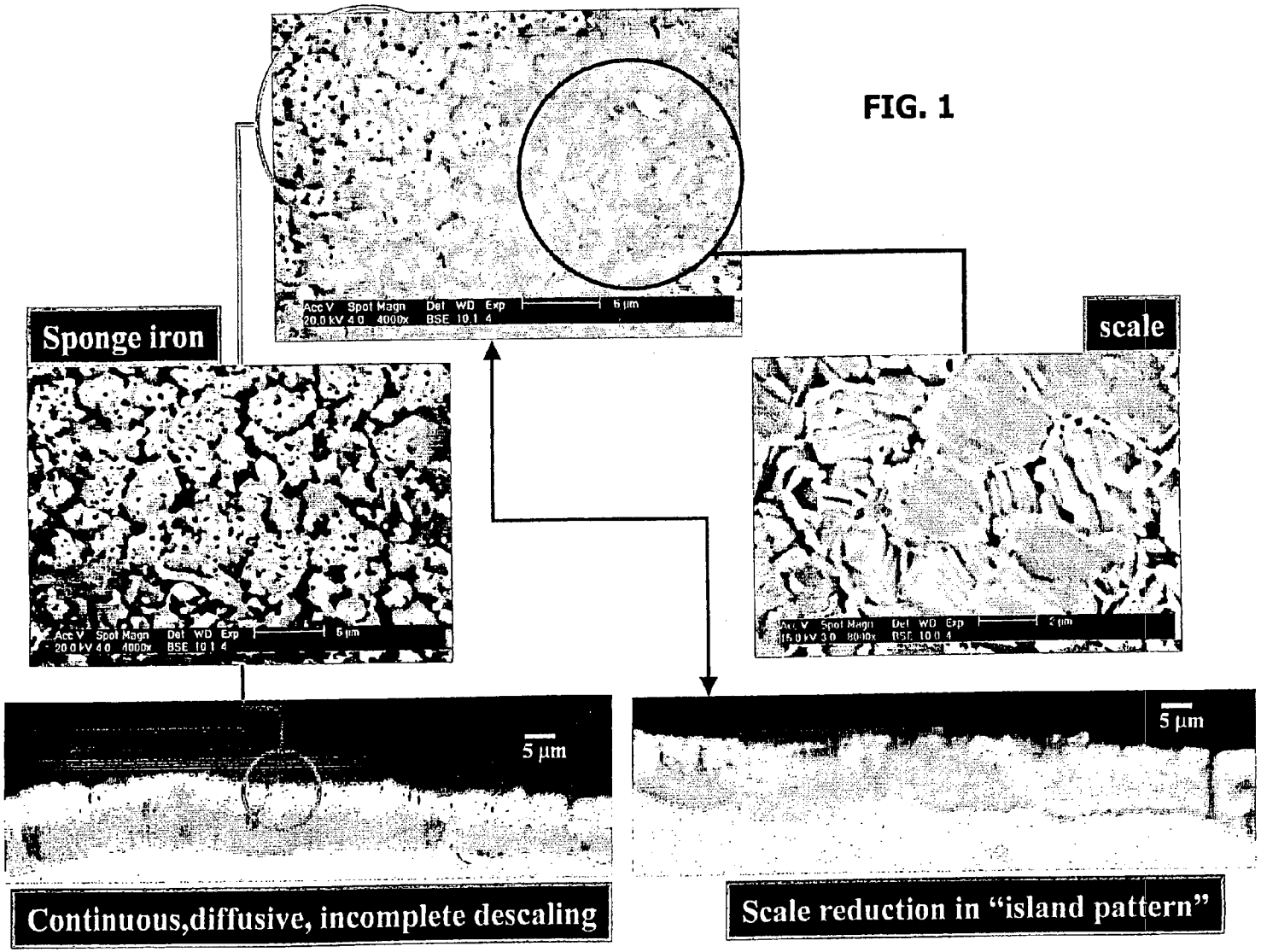
FIG. 1 shows an enlargement of the section of a scale layer affected by irregular reduction.
Figure 2:
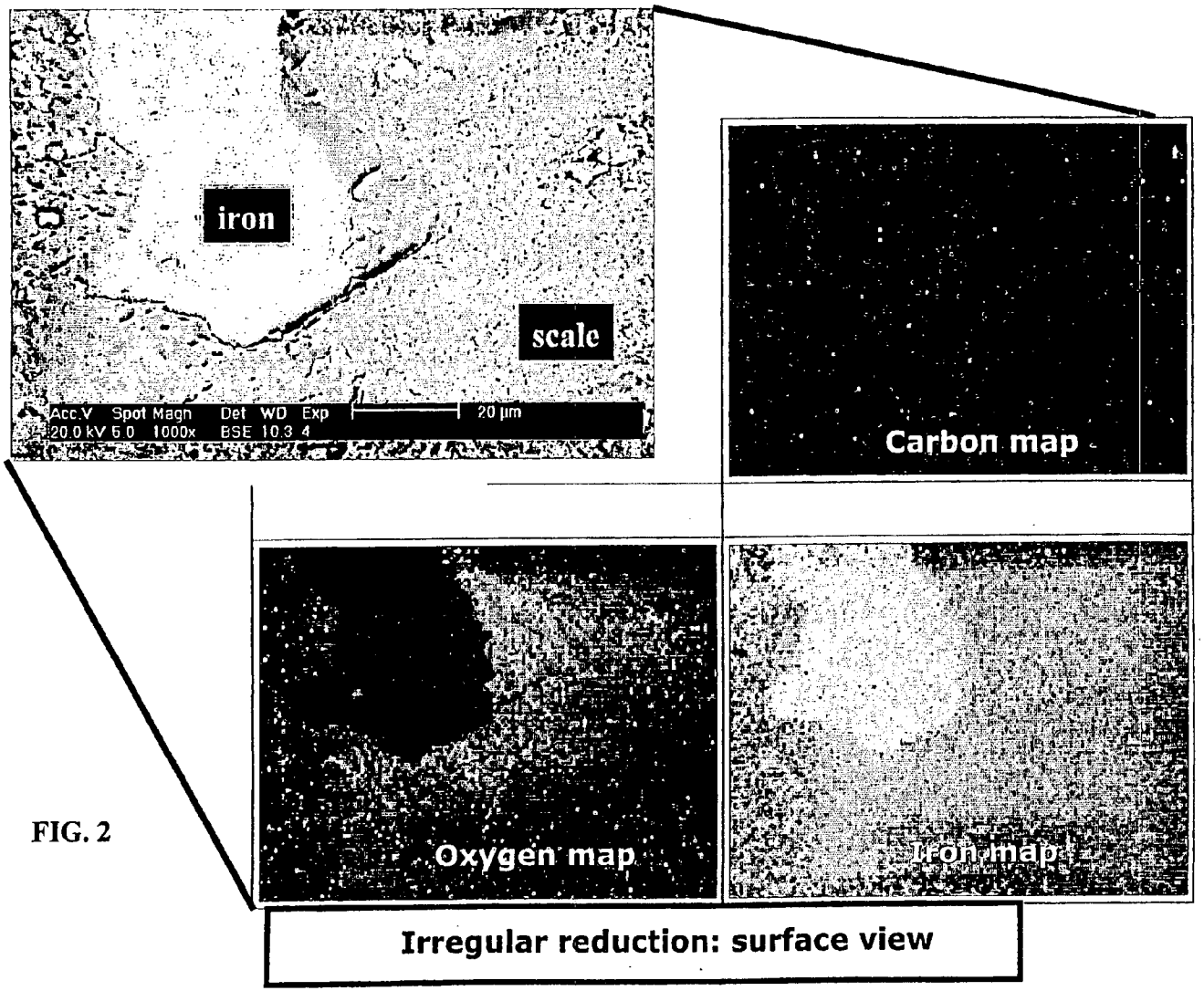
FIG. 2 shows an enlargement of the section of a scale layer affected by non-homogenous reduction.
Figure 3:
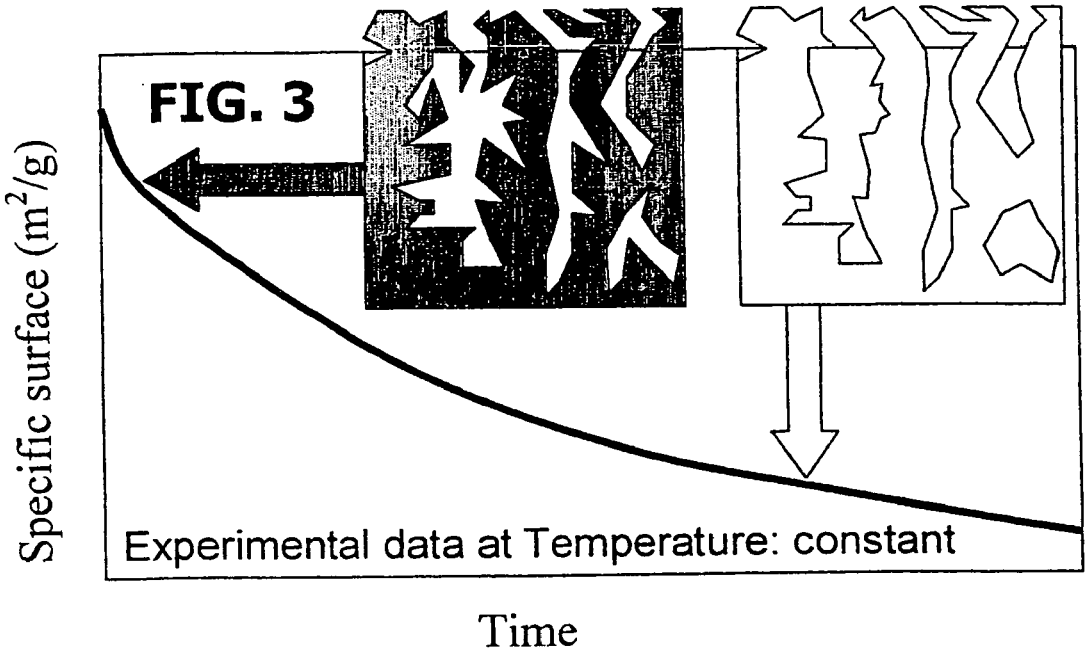
FIG. 3 shows a graph displaying the effect of heating versus time on the specific surface of a scale layer is affected, at constant temperature.
Figure 4:
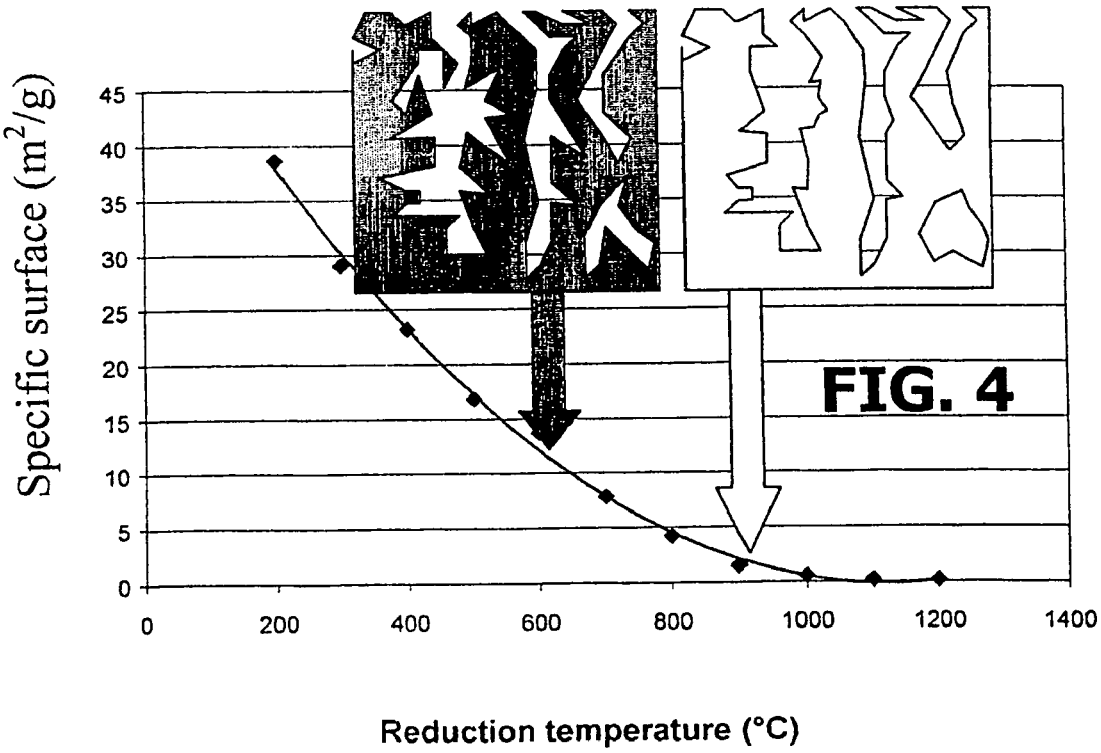
FIG. 4 shows a graph displaying the effect of heating versus time on the specific surface of a scale layer at a constant exposure time.
Figure 5:
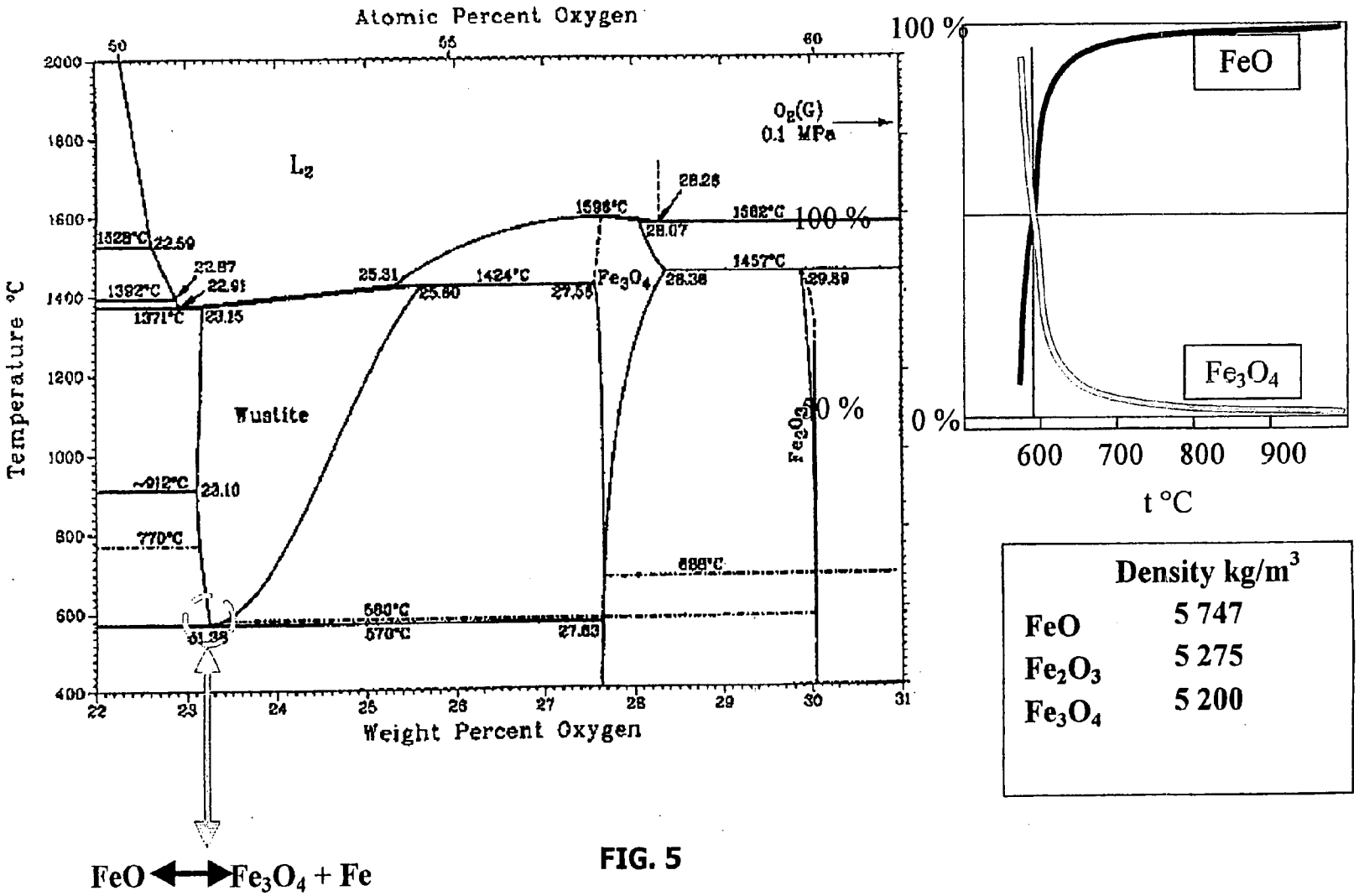
FIG. 5 shows a graph with the phase transformation of the iron oxides.

The structure of the scale and the growth kinetics depend both on the steel and on the atmosphere. Compared to pure iron, steel oxidation is affected by the behaviour of the alloying elements. The phenomena are complex but can be summarized by stating that the scale formed on steel consist of iron oxides and contains FeO, $Fe_3O_4$, and $Fe_2O_3$ and $Fe(OH)_3$ or FeOOH on steel with rusting. In pure air or oxygen, the scale formed on pure iron consists of several layers. Under 570° C., the graphs of FIG. 5 show that FeO is unstable and only $Fe_3O_4$ and $Fe_2O_3$ are present; while, at higher temperatures, an internal layer of FeO forms on the metal in addition to the two oxides.

Considering the above, the heating means of the pickling device in accordance with the invention must be able to provide the energy quickly, keeping oxidation to a minimum or eliminating it completely, and without modifying the specific surface of the material, which would slow-down oxides reduction speed.

The pickling device comprises, in a first advantageous embodiment, a microwave heating system. Microwave heating occurs locally and rapidly. Heat concentrated on external layers produces mainly thermal traction stresses in the oxides layers, producing fissures in the oxides layers before each pickling, be it mechanical, chemical or without acid. Microwaves remain active in the reactor of the process according to the invention only when there remains oxide since the iron and iron sponge substrates reflect microwave energy. The strong link between microwaves and water molecules produced during iron oxide reduction with hydrogen increases heating and reaction kinetics.

Another preferred version of the invention, which is an alternative to the above to described version, features a heating device of the metal product to be descaled that uses intensified radiation.

This device is based on the optimization of the view factor. This view factor is defined as the portion of the total radiant energy emitted by a surface $A_1$ that is captured by a surface $A_2$.

The factor $F_{1-2}$ is the portion of energy that reaches $A_2$ from $A_1$. The following equation is obtained through the reciprocity theorem:

$$A_1 * F_{1-2} = A_2 * F_{2-1}.$$

With said device, it is possible to increase heat exchange and significantly improve the homogeneousness of both the surfaces (the one of the product to be descaled and the one of the equipment for intensified radiation) that act as diffused emitters and present uniform radiance (density of the energy radiated per unit of surface). An important advantage of said solution is that it can be used to perform the heating function in the first part of the pickling process and in the third part of the process, after the reduction phase, for cooling the metal product. The main surfaces of the metal product (for example, in the case of a strip, both the top and bottom surfaces) and the ones of the device for forced radiation behave, at a specific point of the pickling line, like isothermal opaque grey surfaces in the steady state. This inventive configuration of the heating device considerably increases the efficiency of the process implemented with the device of the invention since the surfaces emit and absorb in a diffused manner. The overall effect is incremented by the fact that the atmosphere between the two surfaces does not contribute, meaning that it does not absorb or disperse, to the radiation of the surface and does not emit any radiation, in the case of an inert or reducing atmosphere or of the products of reaction. In fact, the gases that do not have a polarity are transparent to the radiation and the only type with a polarity, water vapor, is always kept under a certain level, for example with the use of dehumidifying means.

Although the optimal heating methods should not lead to the direct contact of the product surfaces with the combustion products, the process of the invention produces excellent results even with the use of direct-fired burners, both with a naked and partially screened flame, regardless of the burnt gas mixture.

This invention makes it possible to use pre-mixed or not burners; sub-stoichiometric, stoichiometric, or over-stoichiometric burners; and air or oxygen burners. Different combinations of convection heating mechanisms can be used for the combustion products together with radiating systems. Any type of radiative heating system, both with electric or gas tubes, is suitable for use in this invention. The geometry of the flame, the content of oxygen and other products in the gaseous state, the area temperature, and the relative velocities between the surface to be treated and the atmosphere in the heating area can be combined in different ways to obtain different heating speeds or different consumptions in order to obtain always homogenous heating that maintains or increases the reactivity of the surface without reducing the specific surface or increasing the thickness of the scale. All these heating treatments are realized without the use of any protective oils on the metal surface to be treated.

Figure 11:
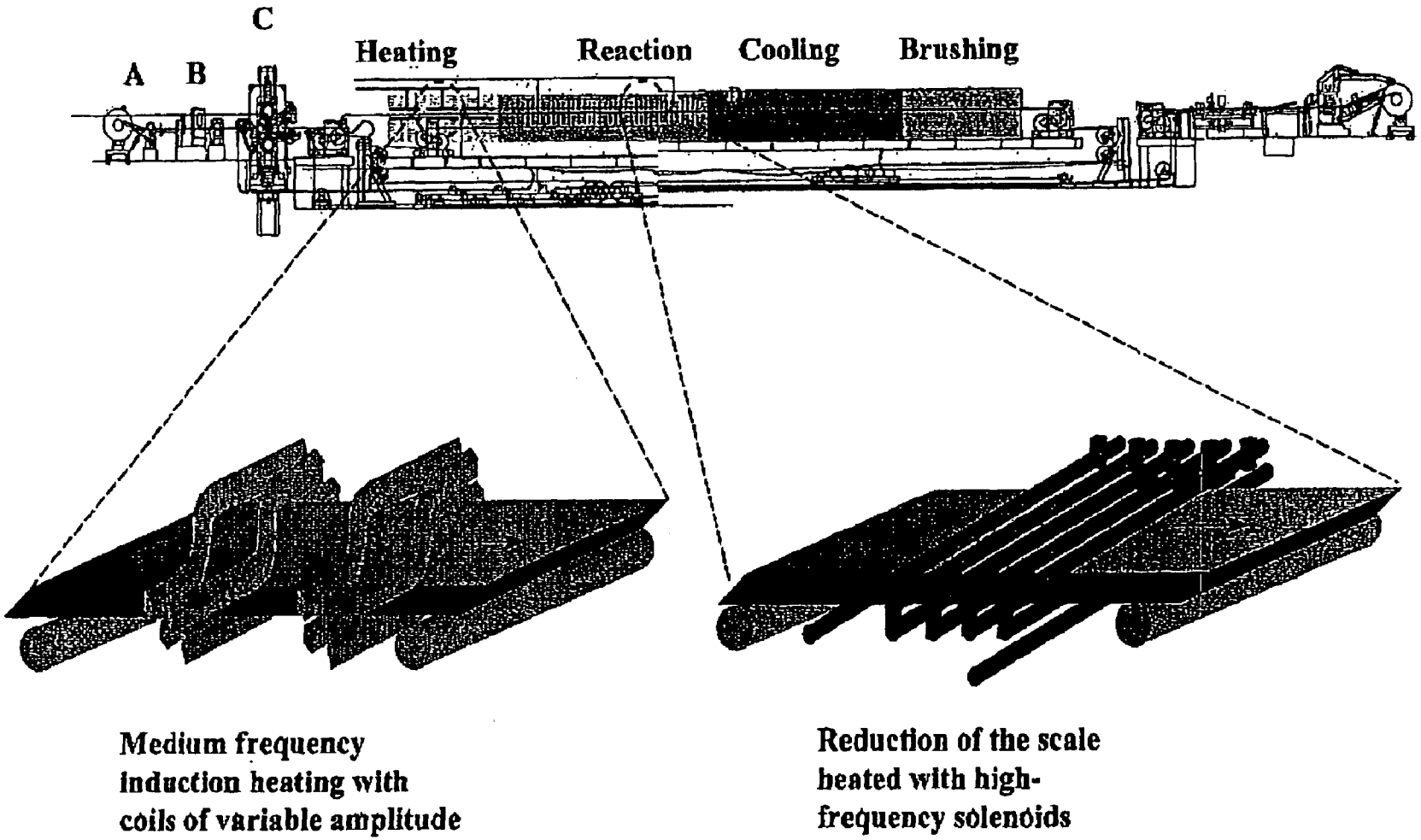
FIG. 11 shows embodiments of induction heating areas in an apparatus according to the invention.
Figure 12:
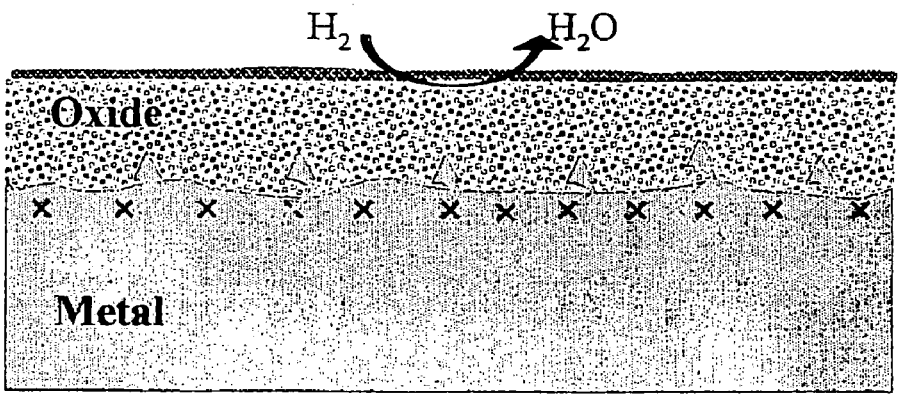
FIG. 12 shows schematically the principle behind the variable frequency control of induction heating
Figure 12:
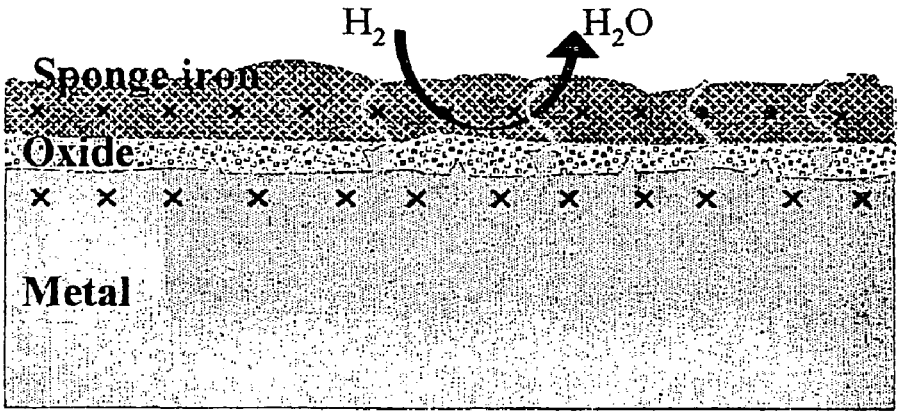
Figure 12:
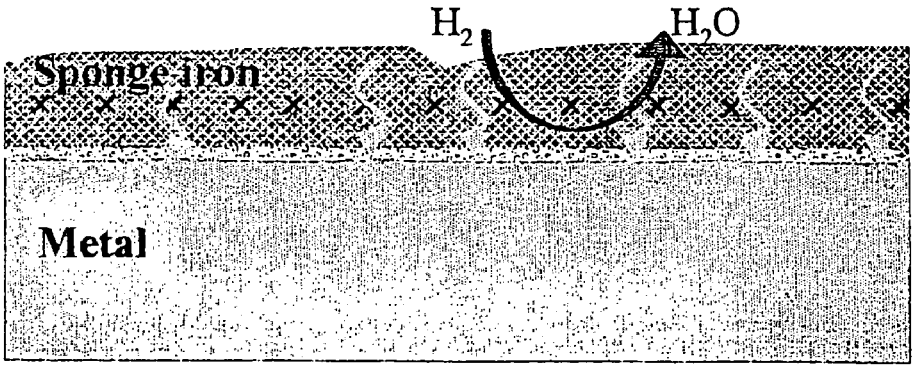

The induction heating method is different from the ones described above since it inverts the sense of the thermal gradient. An induction heating system can be perfectly integrated in the process of this invention both individually and in combination with any of the previously listed heating methods. In particular, this invention features an innovative management of induction heating, the so-called modulated frequency induction heating. FIG. 11 and FIG. 12 show the principle of this process. The heating frequencies are changed as the heating/reducing process progresses in order to generate the thermal flows in the conductive areas closest to the reaction front, limiting electricity consumption and improving the kinetics of the line making it more compact and efficient.

The second phase of the pickling process, which can follow or occur simultaneously with the above described heating phase, advantageously supplies the reducing gas already heated from the start of the process to improve the surface reactivity of the metal product in addition to improving the heating of the product. This should be carried out in particular when hydrogen is used as reducing gas.

The reducing gas can be heated between 300 and 1100° C. making it flow before injecting it into the reaction area through ducts covered with preheated refractory material, or by convection by means of a heated shield on the surface opposite to the one in contact with the gas; either solution does not affect the reduction obtained through the process.

Hydrogen is particularly suitable for heating the metal since it is 15 times lighter than air, is highly convective, has a high thermal conductivity level.

An advantage of preheating with a hot reducing gas is that the reduction starts as soon as the first point of the metal surface becomes active. The formation of the first nucleus of the scale reduced by the gas leads to the formation of a spongy sublayer. The sublayer that has reacted with the gas maintains a much larger specific surface in addition to a deeper and wider porosity. This porous structure exists throughout the heating process. The role of the aforementioned initial nucleus is similar to the one carried out by the cracks in conventional pickling with acid: make the reagent penetrate deeply into the structure of the scale to perform a deep and fast reduction process.

What follows is a detailed description of the behaviour of the flow of the reducing gas over the surface of the metal product, since the control of the fluid dynamic phenomena that occur in proximity of said surface plays a major role in the proper completion of the pickling process in accordance with the invention.

At this level, two physical values are defined that require different control mechanisms but must be correctly balanced to accelerate reduction reaction kinetics of oxides forming the scale by way of a reduction of the conductive and diffusive physical resistances: the thickness of the boundary layer, both laminar and turbulent and the shear stress of the gas on the surface.

In the second phase of the process, the boundary layer and the pressure of the reducing gas on the strip are also controlled. The invention includes the production of pressure oscillations, which follow a regular pattern, on the surface of the metal product. The aim of these disturbancies is both to generate reducing gas feeding zones followed by reaction products evacuation zone and to make the boundary layer unsteady, particularly its laminar sub-layer. In case this layer would be saturated with reaction products, e.g. water vapor, it would inhibit reaction prosecution.

These oscillations are calculated to create a distribution in space that optimizes both the flow of the reducing gas to the surface to be reduced and the immediate removal of the water vapor produced by the reaction. This control is carried out by means of a particularly advantageous configuration of the reactor or of the area of the pickling line where the reaction takes place. This configuration of the reactor facilitates the production of a current along the surface of the metal product with a <<piston effect>>, while the configuration of the channel of the reactor creates an oscillating pressure field fixed in space. By choosing the configuration of the channel of the reactor adequately, it is possible to create pressure oscillations that create a sinusoidal shape or any other type of periodic wave.

Figure 17:
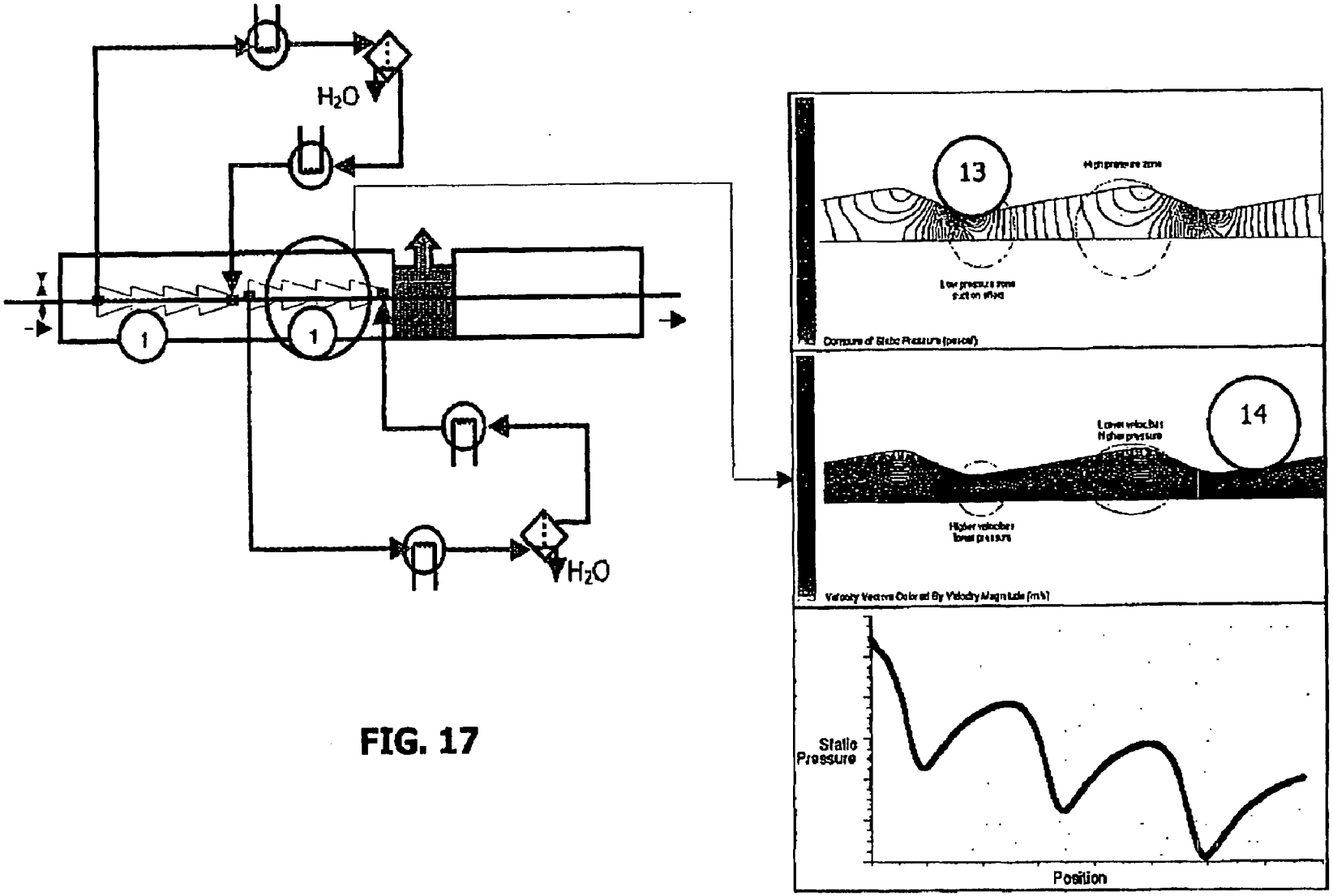
FIG. 17 shows schematically a fluid dynamic configuration along the internal section of the reactor in an apparatus in accordance with the invention.

In a first version of the channel of the reactor, the channel consists of a series of tubes, with a specific pitch separating them as shown in FIG. 17.

The channel of the flow is realized to ensure maximum efficiency for many different types of scale and the fastest possible processing rate; since the optimal frequency does not vary much with different types of scale and the frequency of oscillation of the pressure, seen from the product that advances, it can be adjusted slightly with small changes to the process speed.

Depending on the nature of the metal product to be descaled, the following value ranges are optimal for the main process variables:

Geometrical pitch (P): from 10 to 1500 mm

Oscillation amplitude of the pressure: from 0.1 to 400 $mmH_2O$

Oscillation amplitude of the velocity: from 1 to 80 m/sec

Minimum distance between the channel walls and the product: from 2 to 500 mm

The gas velocity at the surface of the product must be greater than 5 m/sec, as an average in the boundary sub-layer, in every point of the surface of the product to be treated.

Figure 16:
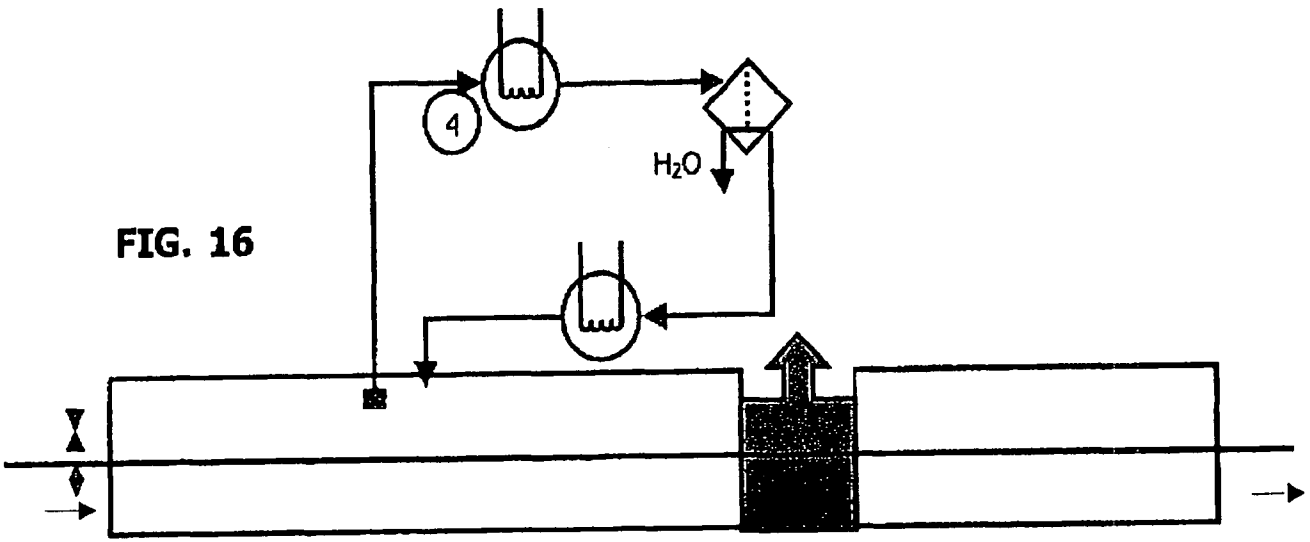
FIG. 16 shows schematically an embodiment of an apparatus in accordance with the invention.
Figure 18:
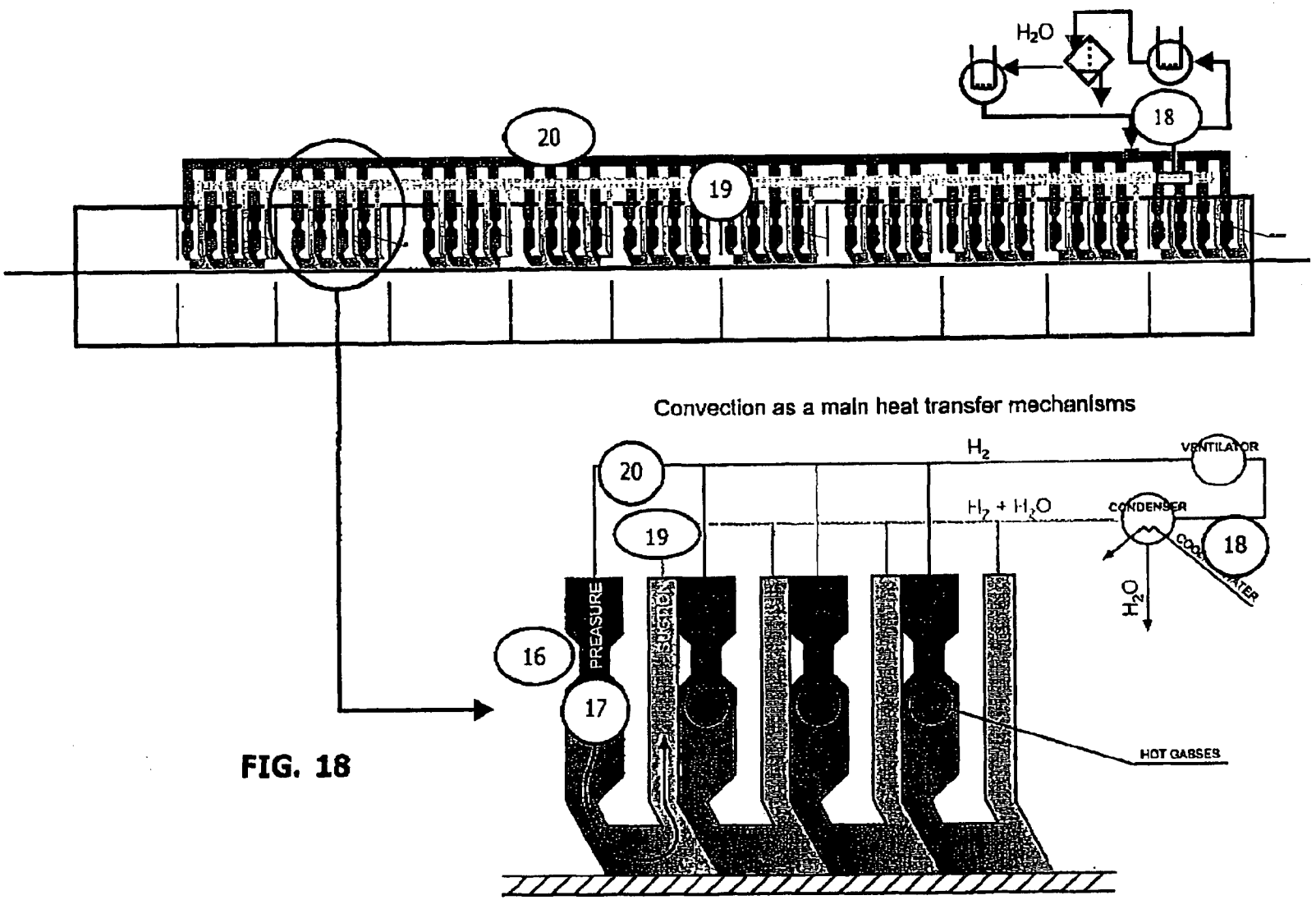
FIG. 18 shows schematically a suction and pressure control system of the reactor in an apparatus in accordance with the invention.
Figure 19:
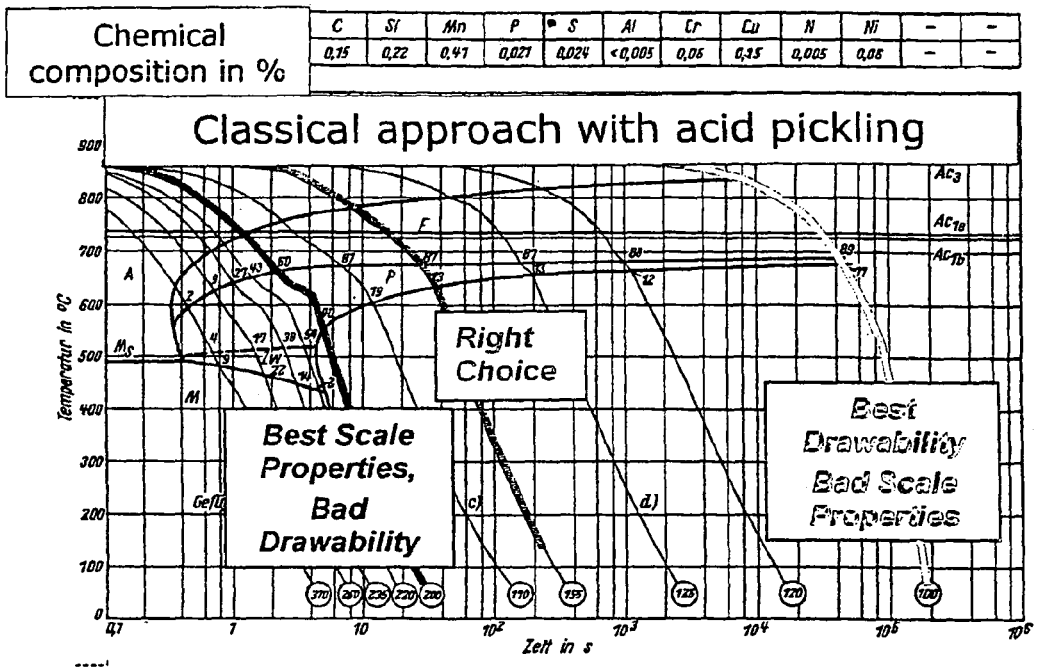
FIG. 19 shows graphs with optimal steel cooling programs using the apparatus of this invention.
Figure 19:
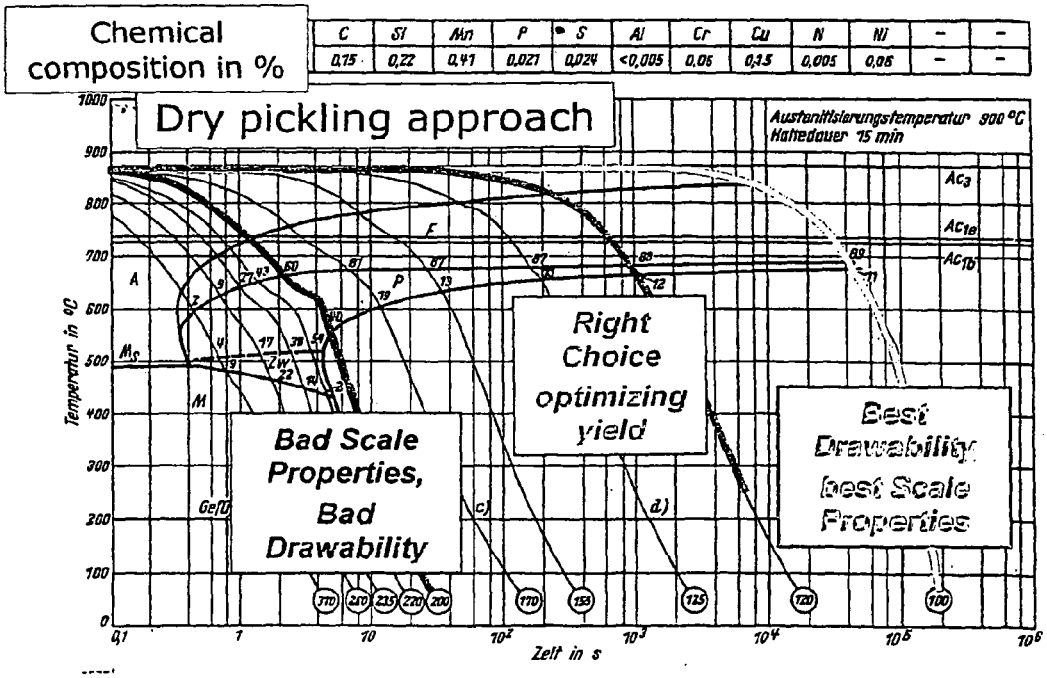
Figure 20:
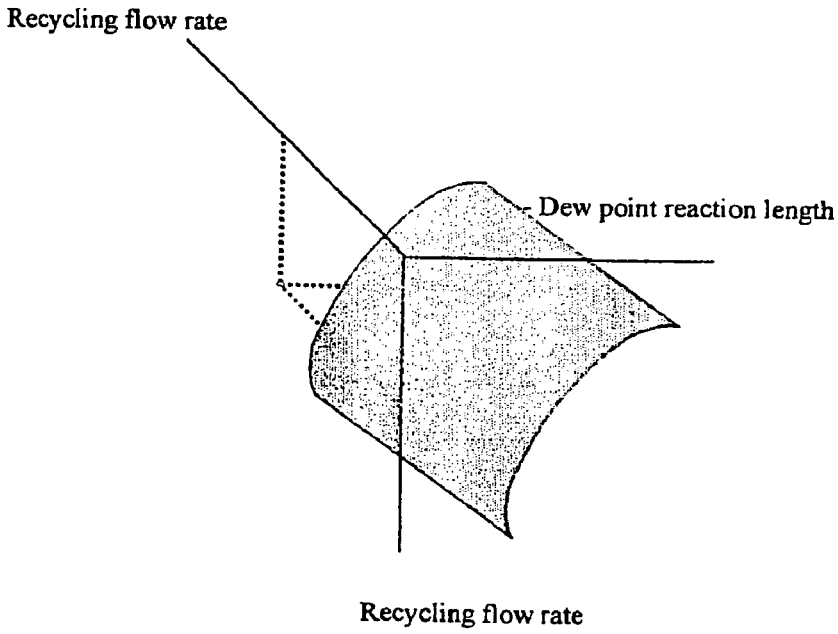
FIG. 20 shows three-dimensional graphs with the equilibrium point for determining the degree of recycling, dehumidification, and efficiency in this invention.
Figure 20:
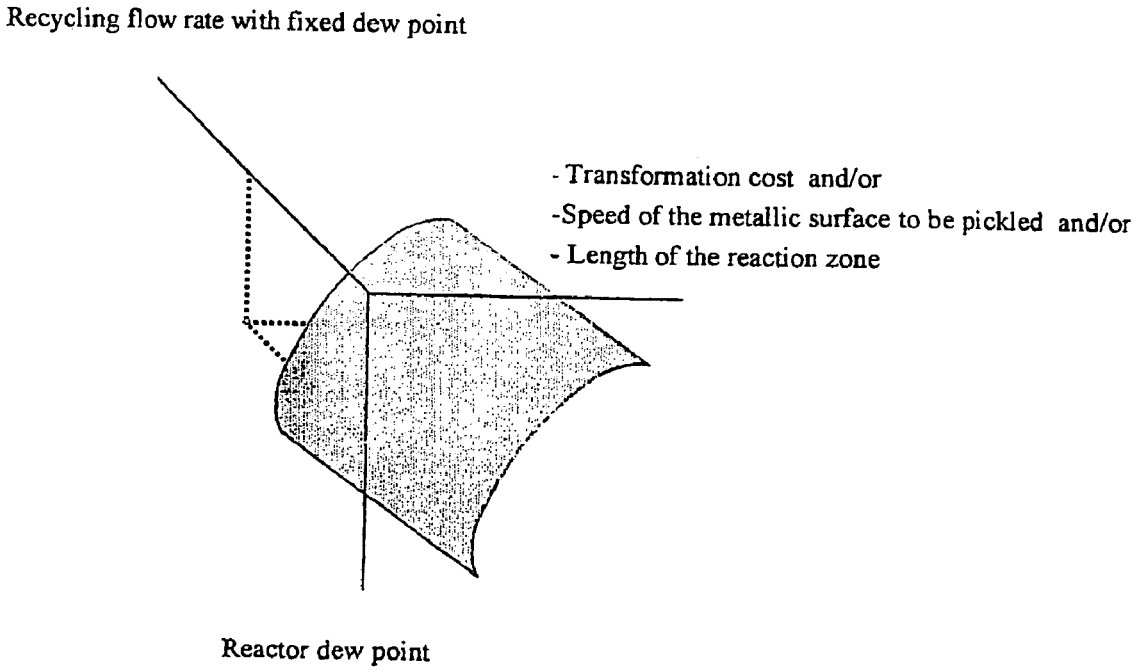

As an alternative to the reactor described above, another form or realization in accordance with the invention, shown in FIG. 16 and in FIG. 18, includes the subdivision of the length of the reaction into a number of segments, each equipped with tubes, in order to ensure the alternation of the pressure effect (overpressurized area), which ensures the penetration of the reducing gas, with the suction effect (depressurized area), which ensures the elimination of the reaction products. The invention includes a series of heating tubes, each of which is located after a respective Venturi tube 16, 17, arranged with the axis perpendicular to the surface of the metal product. In each tube, the reducing gas is heated before heating the surface of the product. The gas is supplied through a common duct 20 and suctioned toward the dehumidification system 18 by another independent duct 19. FIG. 18 shows schematically only the part above the metal product to be treated; however, it is understood that the part underneath the metal product, in this case a strip, is symmetric and has been omitted in the figure only to facilitate understanding.

The above described means, which enable the control of the fluid dynamics of the boundary layer, are ideally placed at a distance from the surface to be treated comprised between 2 mm and 500 mm.

In another version of the reactor in accordance with the invention (not shown in the figures), it is possible to combine the two solutions described above regarding the channel of the reactor. The advantage is that the system becomes insensitive to particular circulation programs with parallel or counter flows. FIG. 17 shows how the direction of the flows of the reducing gas, including any recycled gas, regardless of whether they flow in the same or opposite direction, the pressure 13, and the changing static pressure of the velocity fields 14 are independent from each other.

Figure 23:
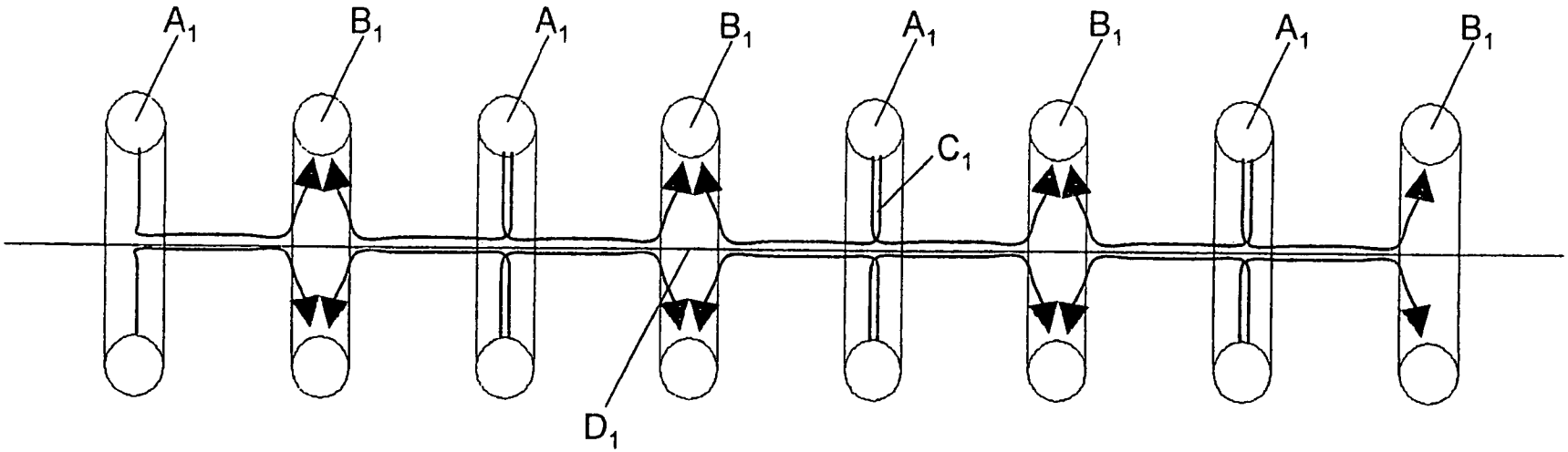
FIG. 23 shows schematically another embodiment of a part of an apparatus in accordance with the invention.

A further advantageous embodiment, shown in FIG. 23, consists of a plurality of perforated diffusers collectors $A_1$ generating organised jets $C_1$ on the strip surface alternated to a plurality of perforated evacuation collectors $B_1$ providing evacuation of reaction products. In this case the outflow jets generate an interruption of the boundary layer $D_1$ and a complete mixing of the reaction products which are on the surface with the reducing gas flow.

The evacuation collectors $B_1$ provide the evacuation from the reactor of the gas contaminated by the reaction products. A simplified embodiment, having a similar efficiency, is obtained by taking off the evacuation collectors $B_1$ placed between two blowing collectors $A_1$ and producing a gas evacuation effect by means of a collision of the streams generated on the strip surface by two consecutive jet rows. These two tangential flows directed in opposite directions generate, by colliding, a zone $D_1$ of high turbulence and underpressure from which the gas is moved away orthogonally to the strip surface.

An advantage of the solution of the invention is that since every lamination scale has its own morphology and roughness of the surface of the product, the reaction velocity and the removal of water vapour can be adequately increased by selecting precise types of waves (pressure oscillations and amplitude of pressure and frequency differences over time).

The special configuration of the reactor that creates the surface pressure oscillations has the advantage of removing water vapor from the surface of the metal product much more efficiently than in conventional reactors. Pressure oscillations, in fact, destabilize the layer of water vapor and cause the water to be suctioned from the surface.

In conventional reactors, instead, the presence of the layer of water on the surface of the product slows down the reaction process between hydrogen and the scale for a chemical effect, since the reducing gas partial pressure is lessened and because the adsorbed water on the oxide surface does not leave free places to the hydrogen for adsorption and for the reducing reaction.

This negatively affects the efficiency of the process.

In pickling plants, the content of water in the oxide that forms the scale must be low enough to allow acceptable reduction speeds; hence, this content must be kept below 5% in volume at all times and in all points of the reaction segment. This segment is comprised between the point in which the product has a temperature of 100° C. and the point where the product reaches its maximum temperature. This tight control on the levels of water vapor is assured by the presence of the aforementioned recycling equipment fitted with said dehumidification system.

Figure 15:
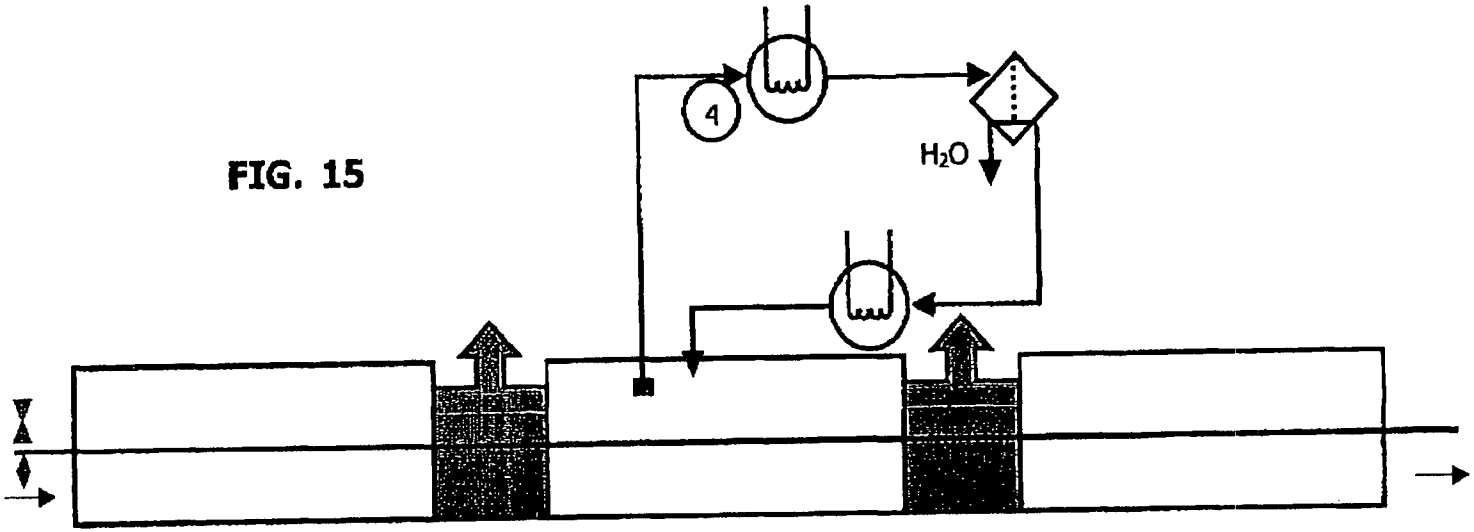
FIG. 15 show schematically an embodiment of an apparatus in accordance with the invention.

A dehumidification system in accordance with the invention, which can be used in combination with either described form of realization of the reactor, is shown in greater detail in FIG. 15. This can be of the cryogenic type, with an absorption or mechanical mechanism depending on the dimensions of the pickling plant. It includes a heat exchanger 4 for the primary elimination of the water after the dehumidification system. A second unit of heat exchangers brings the gas to operating temperatures. The first part of the last heat exchanger is the same as the one described above 4; in addition, it includes an optional unit for remitting the gas in the channel of the reactor at the appropriate convective potential.

This dehumidification system is balanced in accordance with the diagram in FIG. 11. The gas flow rates vary from 1000 $Nm^3/h$ up to 50000 $Nm^3/h$, and the dew point of the recycled gas ranges from −50° C. to 0° C.

In the second stage of the process, thanks to the presence of hydrogen as reducing gas at a high temperature and thanks to the particular way of making the gas flow in the reactor, the reduction process takes place; this will be described in more detail below.

Figure 13:
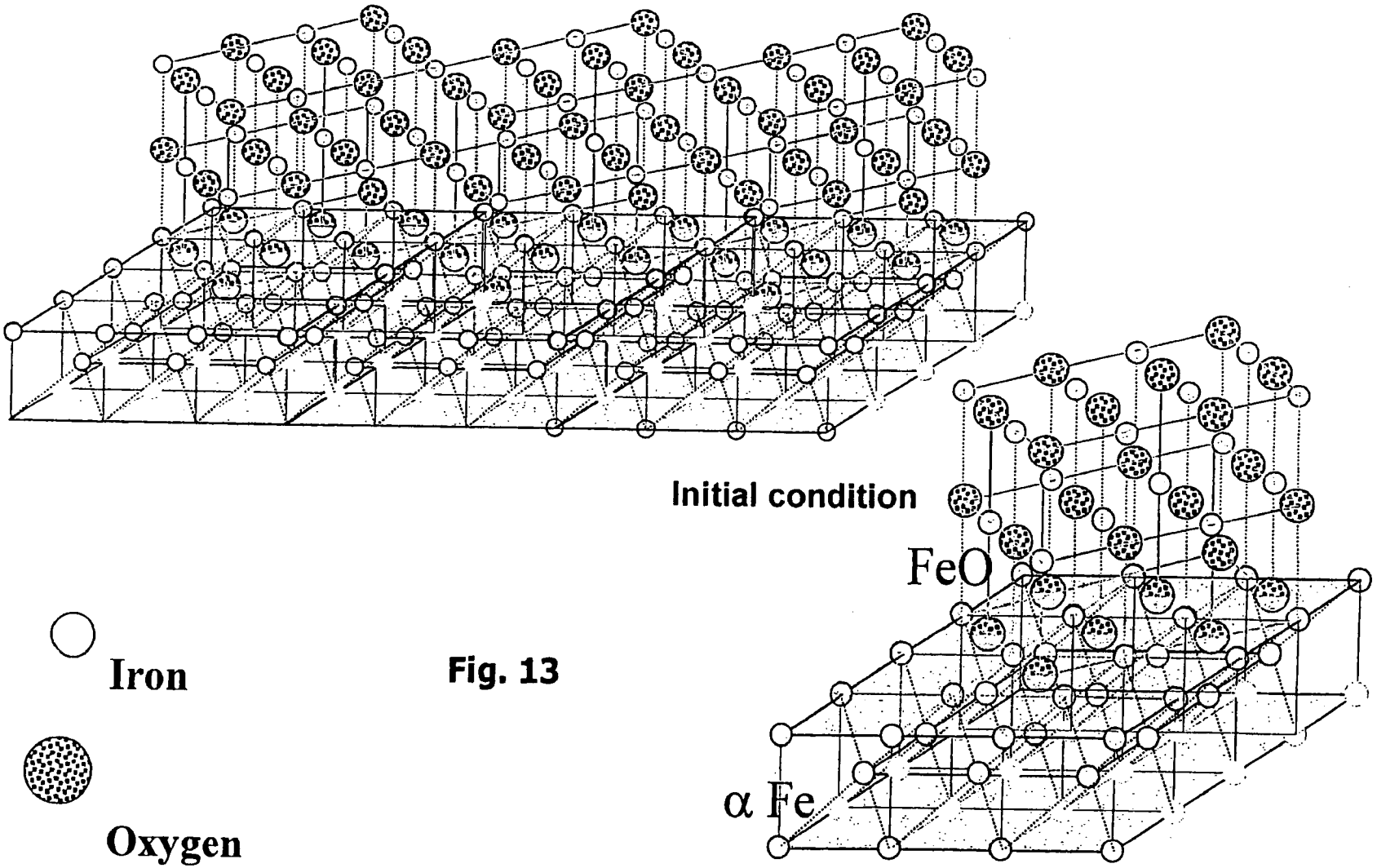
FIG. 13 shows the three-dimensional microscopic structure of the surface of the metal product to be treated before the reduction stage in the pickling process carried out in the device in accordance with the invention.
Figure 14:
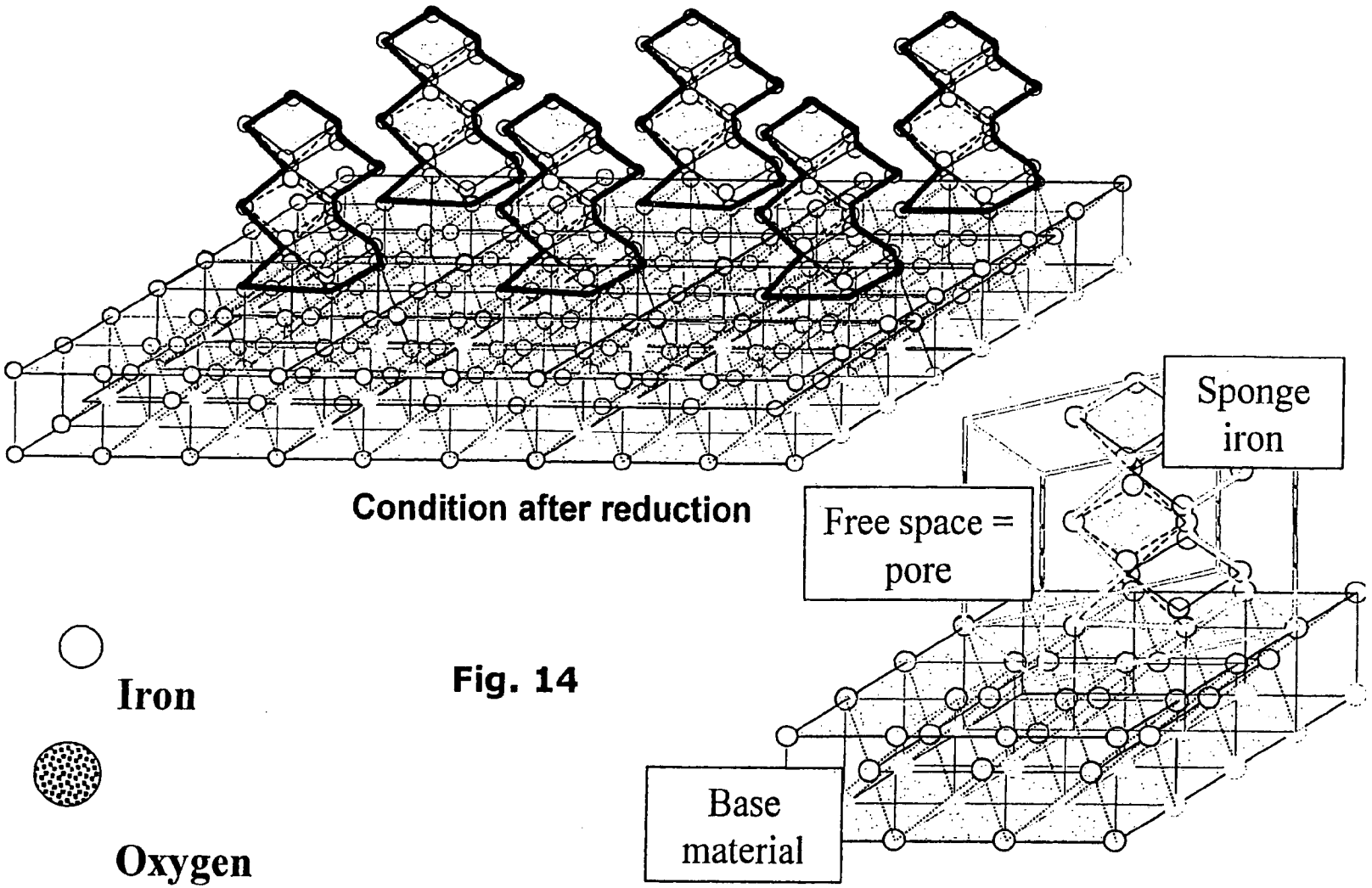
FIG. 14 shows the three-dimensional microscopic structure of the surface of the metal product after the reduction stage in the pickling process carried out in the apparatus in accordance with the invention.

Summarizing what was mentioned above, the following steps are required to reduce the iron through the use of hydrogen in the process of the invention:

Migrating the hydrogen to the surface of the product adsorbing the hydrogen;

dissociating the hydrogen;

performing the atomic diffusion of the hydrogen in the FeO lattice;

performing the dissociation and reaction of the oxide;

eliminating the water inside the scale layer through diffusion in the gaseous phase;

eliminating the water at the interface between the gas and scale layer; if the local conditions are in equilibrium, the water cannot be eliminated; at equilibrium, the ratio between $H_2$ and $H_2O$ is equal to 2 to 1; an addition of hydrogen at a three-dimensional velocity range is necessary to eliminate the water;

rearranging the iron atoms and creating the metal bond:

rearranging the oxygen and iron;

allowing the reaction to take place between the dissolved hydrogen and the oxygen;

diffusing the iron and forming a new lattice;

removing the internal oxygen;

rearranging the iron only;

forming a new sponge iron or porous structure with large empty gaps;

FIGS. 13 and 14 show the morphological change at the microscopic level that takes place on the surface of the product that is treated using the process of the invention.

An advantage derived directly from the pickling process of the invention is that the changes to the surface of the product that occur at a very early stage of the process, due to the formation of the macroscopically porous structure, increase the reactivity of the material regardless of the used heating system in the initial phase of the process, whether the system consists of burners, radiant tubes, electric, induction, electromagnetic, etc. The essential condition to guarantee high kinetics in the reaction is the proper removal of the water from the layer involved in the reaction. The removal of water also depends on the original structure of the scale (essentially unchangeable) and sponge iron, which forms in the early stages of the process, and on the partial water pressure on the boundary layer, which is controlled by the thermal fluid dynamic devices described above.

What follows is a description of the third stage of the process in accordance with the invention.

A very interesting aspect of the dry descaling process carried out in the device of the invention is that it allows better adjustment between the cooling program of the product in the train of rolls and the nature of the scale, especially for drawing that takes place later on. The cooling choice is a compromise between optimal scale results and the levels of production of the rolling mill.

In the cooling process of the invention, reactivity is not very affected by the nature of the present oxide; rather, it is more affected by the geometry of the surface.

The cooling program of the product can be chosen as a function of the desired productivity, but staying close to the optimal microstructure and scale thickness, since the longer the product is kept at a higher temperature, the thicker the scale and the lower the productivity.

Compared to the process that can be implemented using the device of the invention, known pickling processes involve a cooling program that cools the product very quickly to bring it to the temperature where the formation of FeO takes place. This produces an almost homogenous layer that can be easily removed by pickling with acid the mixed $Fe_2O_3/Fe_3O_4$ layers. The result is a compromise between the material characteristics required for good drawing and the nature of the scale to be removed.

Figure 21:
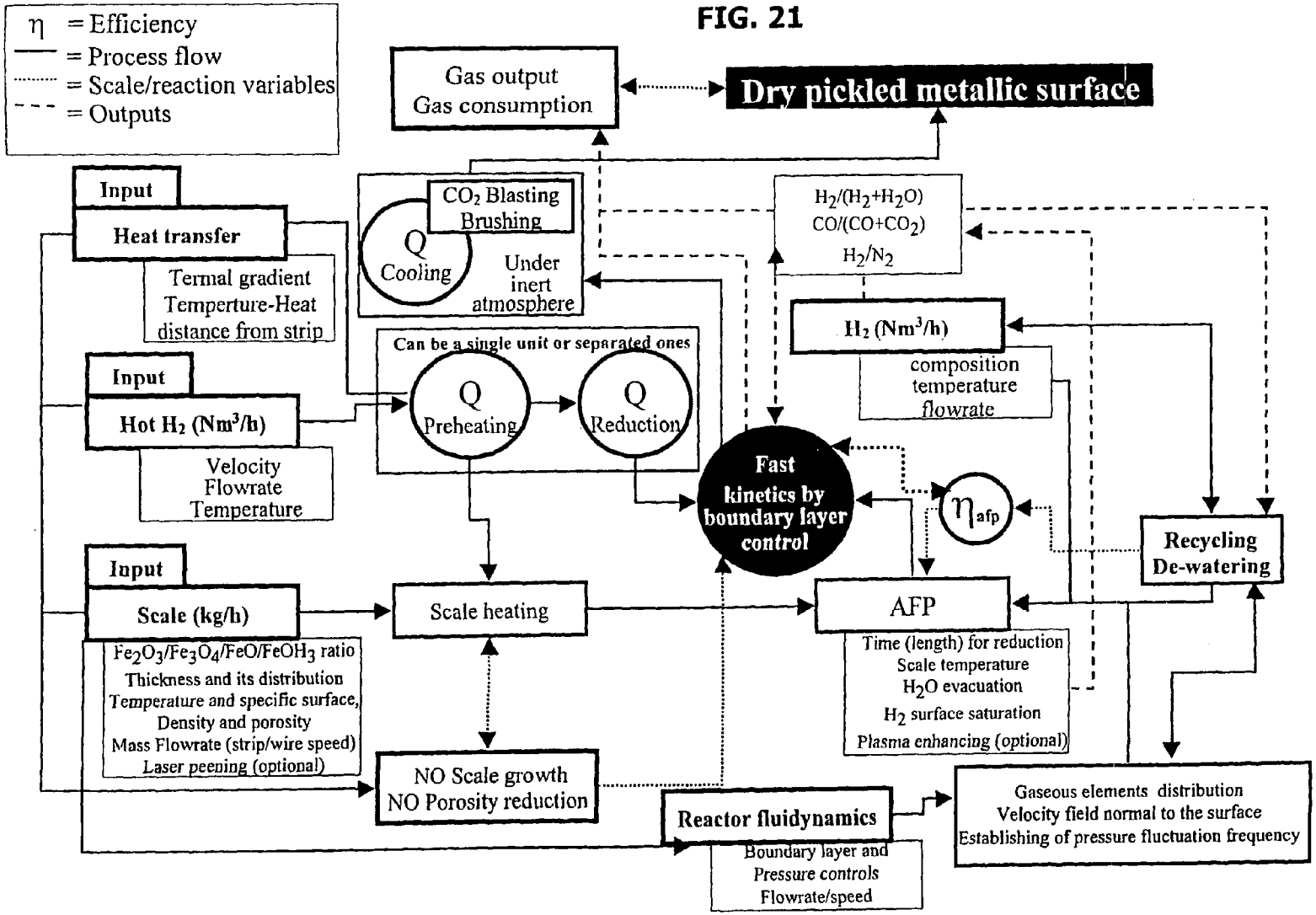
FIG. 21 shows a general diagram of the process of the invention displaying the relation between the variables and the process flow.

FIG. 21 shows a schematic view of the pickling process of the invention, with the relation between the process variables.

The innovative characteristics of this process, make it possible to obtain a reaction rate greater than in reaction stages of known processes.

Figure 22:
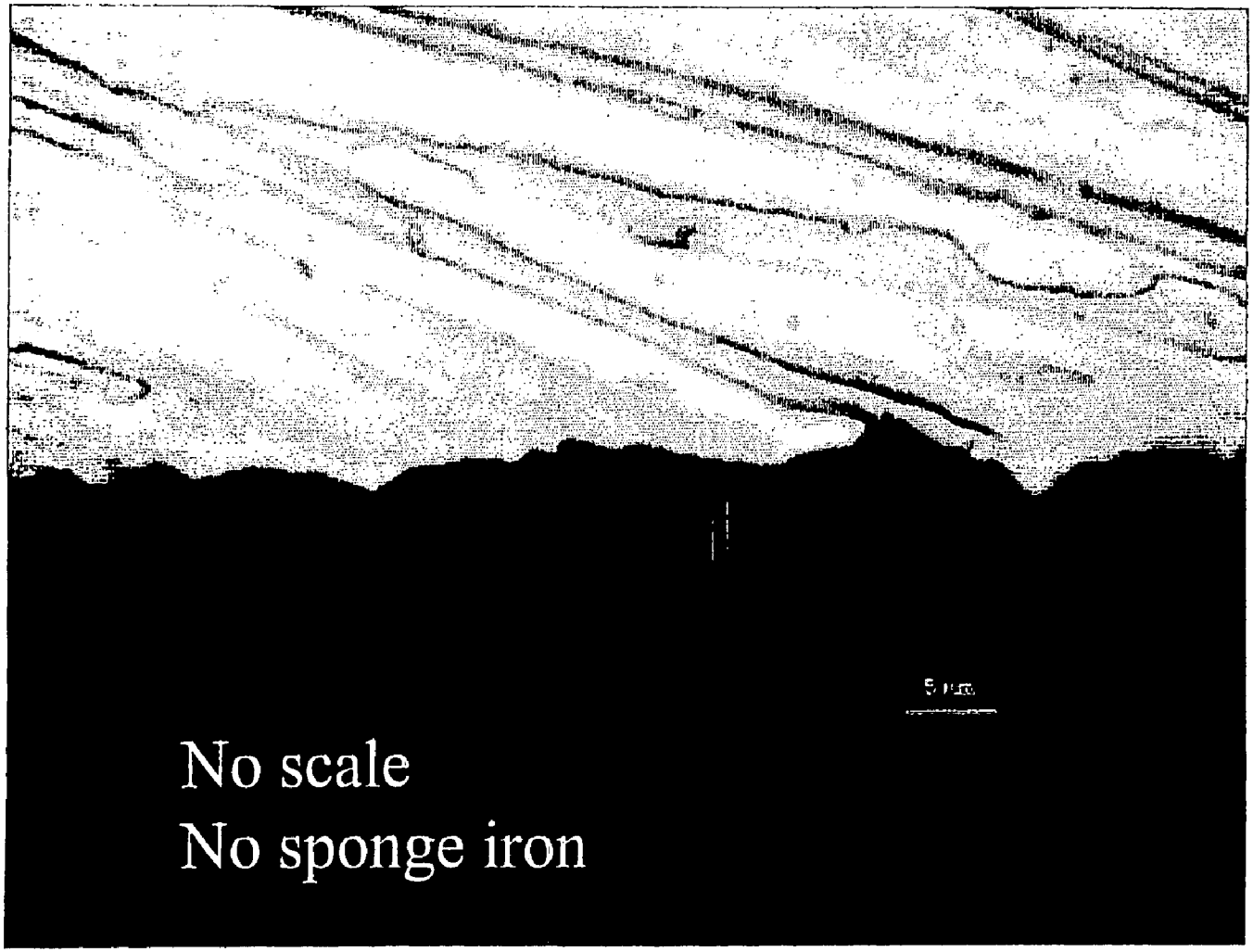
FIG. 22 shows the structure of the strip after reduction and after mechanical brushing to remove the sponge iron.

The cooling of the product after reduction occurs by means of forced convection using hydrogen as cooling gas. The use of other gases of the inert type (nitrogen, argon) can be used but leads to thermal/chemical inefficiencies and construction problems. The use of hydrogen reduces the length of the plant and brings the temperatures of the reduced material below the reoxidation temperature limit. The layer of sponge iron can be easily removed totally and homogeneously by mechanical means (brushing, shot peeing, $CO_2$, etc.). The surface structure of the strip after the reduction treatment and brushing is shown in FIG. 22.

The dry descaling operation consists in removing the oxygen from the scale of iron and in leaving a layer of "sponge iron" that is removed from the surface by a mechanical action (brushing, shot peeing, $CO_2$, etc.). Brushing, in this case, is not a true pickling operation because only iron is removed, since the oxide has already been removed.

Figure 6:
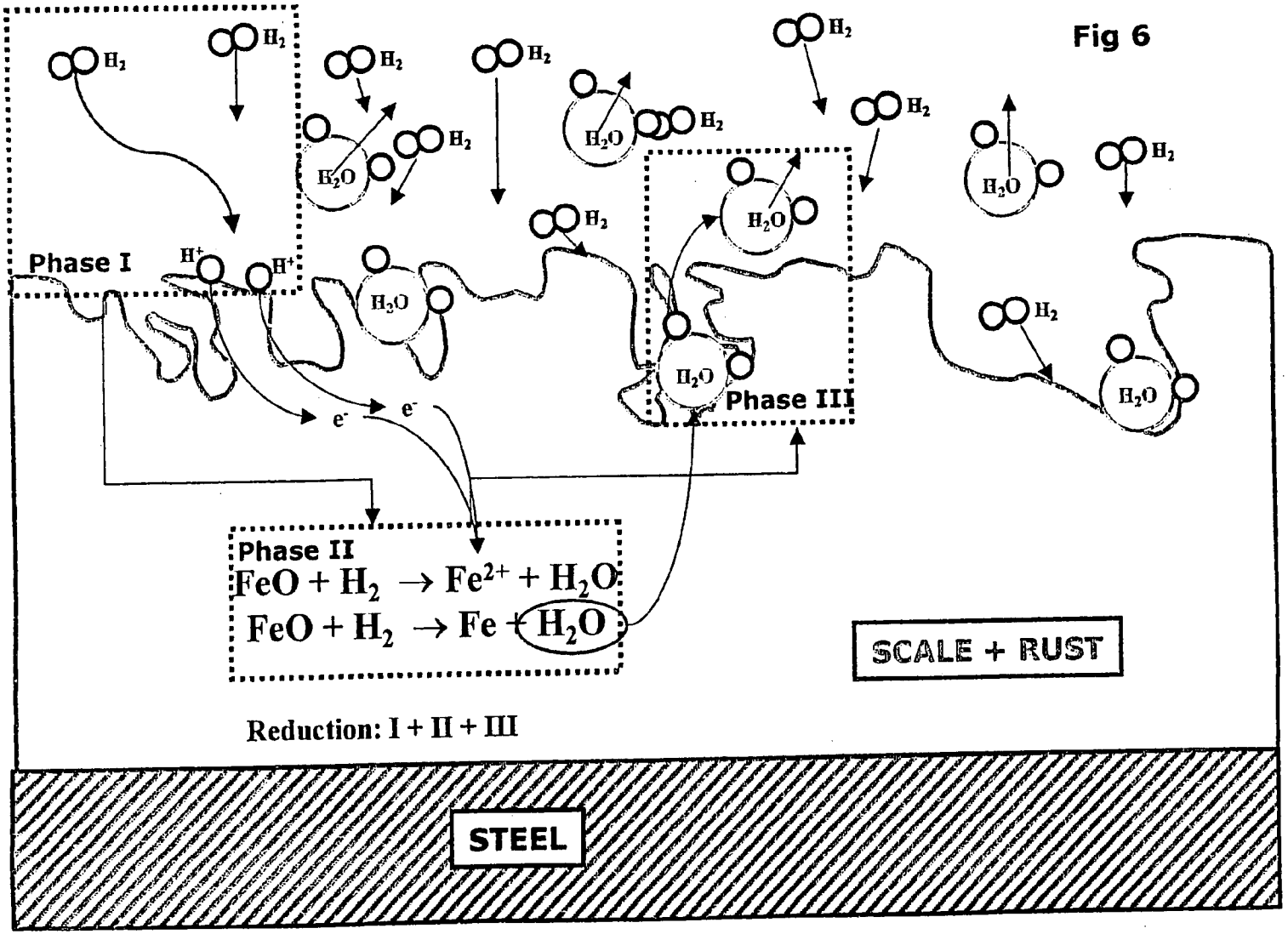
FIG. 6 shows the reduction process of the scale on the surface of the treated product.

FIG. 6 shows the process of the invention in graphical form; the three main sequential phases are shown, specifically: the injection of the gas in close contact with the surface to be reduced, the reducing reaction, and the removal of the reaction products (water) to free other sections of the surface so that reduction can take place.

Figures 7, 8:
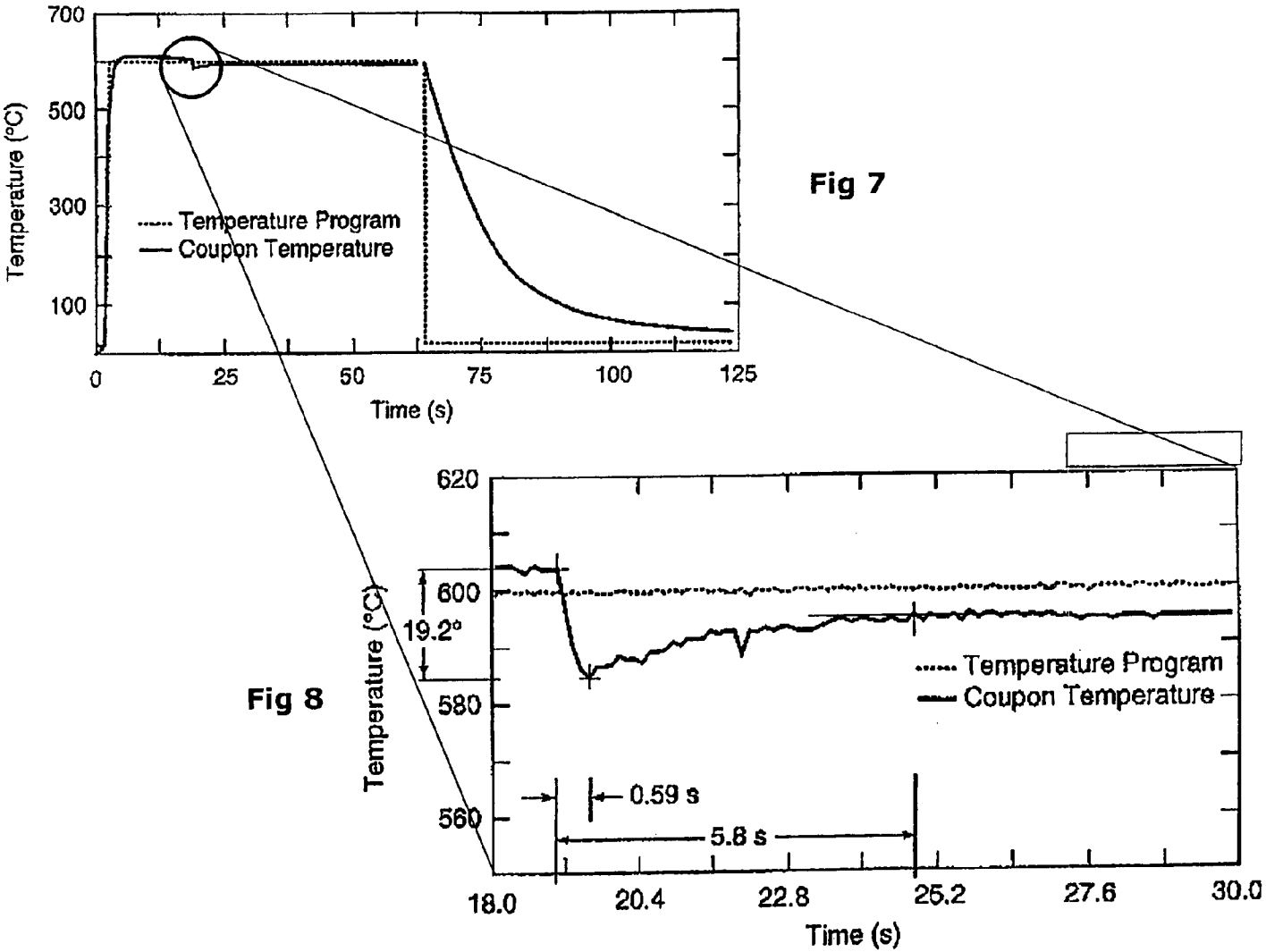
FIGS. 7 and 8 show the results of reduction tests in an initial vacuum with heating of the sample.
Figure 9:
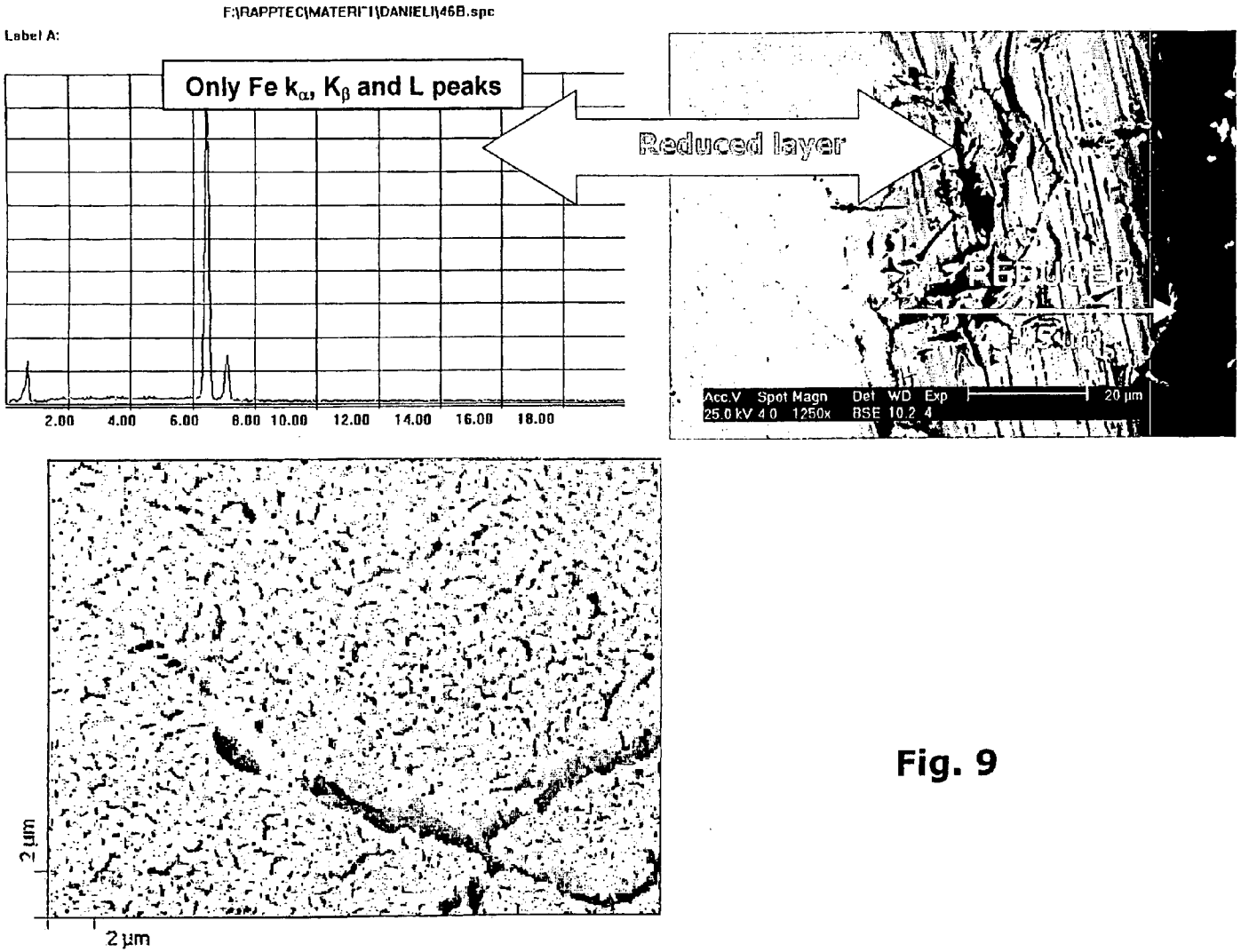
FIG. 9 shows the analysis of the sample after the reduction reaction described in FIGS. 7 and 8.

FIGS. 7 and 8 show the results of the reduction tests in an initial vacuum with heating of the sample. When the hydrogen is injected, the reaction is denoted by a drop in the temperature (endothermic reaction). This test shows that the reduction reaction is practically instantaneous; thus, it is necessary to optimize the reagent supply phase and the removal of the water phase by controlling the boundary layer and creating alternating pressure and suction areas. FIG. 9 shows the perfectly homogeneous progress and the completed reduction reaction shown in FIGS. 7 and 8.

Since the process consists of a series of successive subprocesses, the overall kinetics will be dictated by the slowest process. These tests show that the chemical reaction is almost instantaneous and that any increase of the kinetics can only be obtained by carefully controlling the thermo fluid dynamics.

The process is particularly suited to pickling metal products coming directly from the rolling mill or products that come wound around coils, unwound from the coil, and heated. In fact, the process does not change any of the properties of the rolled material. No phase transformation occurs since the material does not exceed any transformation line. The process is optimized to achieve reactivity as of the lowest temperature and as soon as possible; other goals include performing the process in a contained length plant and reducing the duration of the process. Besides taking place without the use of acids, the process also does not use condensing reagents, which would slow down the speed of reaction.

The process is carried out in a single pass of the product through the pickling plant, at a speed that can vary between 10 to 100 m/min; the product must stay in the reaction area for minimum 20 sec and maximum 90 sec.

This is suitable for any type of scale and for every type of thickness distribution and phase on the product. It can be used even with scaling having a thickness that varies along the product.

A preferred version of the acid-free pickling plant sizes the device so that it can treat from a minimum of 50,000 t/year to a maximum of 1,000,000 t/year of metal products.

The invention claimed is:

1. A dry descaling apparatus for scale removal from a surface of a metal product comprising at least one heating area for heating the metal product, at least one reducing area for performing a reaction between a metal-oxide reducing gas and at least the scale, at least one area for cooling the metal product, first heating means for heating the metal product, second heating means for heating the reducing gas, means for removing reaction products from the reducing gas after reaction, means for removing reaction products which are left on the surface of the metal product after treatment, and means for cooling the metal product;

a dry-pickling apparatus being characterised by the fact that it comprises first control means (16, 17, $B_1$, $C_1$) for fluid dynamic control of the boundary layer produced by the flow of said reducing gas over the surface of said metal product wherein said first control means are adapted for generating regular pressure oscillations comprising overpressure and depression areas, which are repeated in succession along the entire surface of said metal product, the overpressure areas being associated with a reducing gas blowing stage towards the surface of said metal product, the depression areas being associated with a reducing gas evacuation phase downstream of the blowing stage, means for purging and recycling reducing gas after reducing operation of the scale, third control means for controlling reducing gas temperature;

wherein said first control means comprise a plurality of coaxial Venturi (16,17) tubes placed at a reciprocal distance between 10 mm and 1500 mm and having their axis positioned along the conveying direction of the metal product.

2. An apparatus as claimed in claim 1 wherein pressure is above +10 Pa in said overpressure areas and where pressure ranges above −2 Pa in absolute value in said depression areas.

3. An apparatus as claimed in claim 1 wherein said first control means are positioned at a distance from the surface of said metal product comprised between 2 mm and 500 mm.

4. An apparatus as claimed in claim 1 wherein the first heating means comprise a microwave device.

5. An apparatus as claimed in claim 1 wherein the first heating means comprise a heating convective flow of the reducing gas previously heated to a temperature between 300° C. and 1100° C.

6. An apparatus as claimed in claim 1 wherein the first heating means comprise induction heating elements with or without frequency modulation.

7. An apparatus as claimed in claim 1 wherein the first heating means comprise air or oxygen burners having a naked or screened flame.

8. An apparatus as claimed in claim 1 wherein the first heating means comprise gas or electric radiant tubes.

9. An apparatus as claimed in claim 1 wherein the first heating means comprise amplified radiation heating elements.

10. An apparatus as claimed in claim 1 wherein the first heating means comprise a microwave and/or convective flow device for heating the reducing gas previously heated to a temperature between 300° C. and 1100° C. and/or induction heating elements and/or air or oxygen burners having a naked or screened flame and/or gas or electric radiant tubes and/or amplified radiation heating elements.

11. An apparatus as claimed in claim 1 wherein said second heating means comprise at least one duct of hot refractory material through which the reducing gas flows or at least a metal wall heated electrically or by a flame that is licked by said reducing gas.

12. An apparatus as claimed in claim 1 wherein said means for cooling the metal product comprise inert or reducing gas forced convection systems.

13. An apparatus as claimed in claim 1 wherein said means for removing the reaction products from the reducing gas, after reaction stage, comprise at least one cryogenic and/or absorption and/or mechanical plant.

14. An apparatus as claimed in claim 1 wherein said means for removing the reaction products remaining on the surface of the treated metal product are placed after the cooling area and comprise mechanical brushing means.

15. An apparatus as claimed in claim 1, wherein said heating, reducing, and cooling areas are placed in a common chamber including said first and second heating means, said first control means, and said means for cooling the metal product.

16. A descaling apparatus for scale removal from a surface of a metal product comprising at least one heating area for heating the metal product, at least one reducing area for performing a reaction between a metal-oxide reducing gas and at least the scale, at least one area for cooling the metal product, first heating means for heating the metal product, second heating means for heating the reducing gas, means for removing reaction products from the reducing gas after reaction, means for removing reaction products which are left on the surface of the metal product after treatment, and means for cooling the metal product;

a dry-pickling apparatus being characterised by the fact that it comprises first control means (16, 17, $B_1$ $C_1$) for fluid dynamic control of the boundary layer produced by the flow of said reducing gas over the surface of said metal product wherein said first control means are adapted for generating regular pressure oscillations comprising overpressure and depression areas, which are repeated in succession along the entire surface of said metal product, the overpressure areas being associated with a reducing gas blowing stage towards the surface of said metal product, the depression areas being associated with a reducing gas evacuation phase downstream of the blowing stage, means for purging and recycling reducing gas after reducing operation of the scale, third control means for controlling reducing gas temperature;

wherein said first control means comprise a plurality of tube pairs, each tube pair consisting of a heating tube and of a Venturi tube placed downstream of the heating tube, the tubes of the tube pair having axes perpendicular to the surface of said metal product and are placed at a reciprocal distance between 10 mm and 1500 mm.

17. An apparatus as claimed in claim 16 wherein pressure is above +10 Pa in said overpressure areas and where pressure ranges above −2 Pa in absolute value in said depression areas.

18. An apparatus as claimed in claim 16 wherein said first control means are positioned at a distance from the surface of said metal product comprised between 2 mm and 500 mm.

19. An apparatus as claimed in claim 16 wherein the first heating means comprise a microwave device.

20. An apparatus as claimed in claim 16 wherein the first heating means comprise a heating convective flow of the reducing gas previously heated to a temperature between 300° C. and 1100° C.

21. An apparatus as claimed in claim 16 wherein the first heating means comprise induction heating elements with or without frequency modulation.

22. An apparatus as claimed in claim 16 wherein the first heating means comprise air or oxygen burners having a naked or screened flame.

23. An apparatus as claimed in claim 16 wherein the first heating means comprise gas or electric radiant tubes.

24. An apparatus as claimed in claim 16 wherein the first heating means comprise amplified radiation heating elements.

25. An apparatus as claimed in claim 16 wherein the first heating means comprise a microwave and/or convective flow device for heating the reducing gas previously heated to a temperature between 300° C. and 1100° C. and/or induction heating elements and/or air or oxygen burners having a naked or screened flame and/or gas or electric radiant tubes and/or amplified radiation heating elements.

26. An apparatus as claimed in claim 16 wherein said second heating means comprise at least one duct of hot refractory material through which the reducing gas flows or at least a metal wall heated electrically or by a flame that is licked by said reducing gas.

27. An apparatus as claimed in claim 16 wherein said means for cooling the metal product comprise inert or reducing gas forced convection systems.

28. An apparatus as claimed in claim 16 wherein said means for removing the reaction products from the reducing gas, after reaction stage, comprise at least one cryogenic and/or absorption and/or mechanical plant.

29. An apparatus as claimed in claim 16 wherein said means for removing the reaction products remaining on the surface of the treated metal product are placed after the cooling area and comprise mechanical brushing means.

30. An apparatus as claimed in claim 16, wherein said heating, reducing, and cooling areas are placed in a common chamber including said first and second heating means, said first control means, and said means for cooling the metal product.

* * * * *